US010065233B2

(12) United States Patent
Ichimura et al.

(10) Patent No.: US 10,065,233 B2
(45) Date of Patent: Sep. 4, 2018

(54) METHOD FOR MANUFACTURING CAP

(71) Applicant: NIPPON CLOSURES CO., LTD., Tokyo (JP)

(72) Inventors: Katsuhito Ichimura, Kanagawa (JP); Mitsuo Kumata, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 760 days.

(21) Appl. No.: 14/387,723

(22) PCT Filed: Mar. 5, 2013

(86) PCT No.: PCT/JP2013/055939
§ 371 (c)(1),
(2) Date: Sep. 24, 2014

(87) PCT Pub. No.: WO2013/146116
PCT Pub. Date: Oct. 3, 2013

(65) Prior Publication Data

US 2015/0135508 A1 May 21, 2015

(30) Foreign Application Priority Data

Mar. 30, 2012 (JP) ..... 2012-078947
Nov. 22, 2012 (JP) ..... 2012-256738

(51) Int. Cl.
*B65D 41/16* (2006.01)
*B65D 41/18* (2006.01)
(Continued)

(52) U.S. Cl.
CPC ..... *B21D 51/44* (2013.01); *B21D 39/00* (2013.01); *B21D 51/46* (2013.01); *B21D 51/50* (2013.01);
(Continued)

(58) Field of Classification Search
CPC ..... B65D 39/0058; B65D 43/021; B65D 2543/00546; B65D 41/34; B65D 53/00;
(Continued)

(56) References Cited

U.S. PATENT DOCUMENTS 1,333,750 A 3/1920 Bruns
3,415,034 A * 12/1968 Schmitt ..... B65D 69/00 206/515
(Continued)

FOREIGN PATENT DOCUMENTS

GB 1 410 639 10/1975
JP 2003-321040 11/2003
(Continued)

OTHER PUBLICATIONS

Search report from International Bureau of WIPO, dated Apr. 23, 2013.

*Primary Examiner* — Sarang Afzali
*Assistant Examiner* — Darrell C Ford
(74) *Attorney, Agent, or Firm* — Greenblum & Bernstein, P.L.C.

(57) ABSTRACT

A method for manufacturing a cap, which can insert a sheet member easily into a predetermined position of an upper part inside a cap body, without causing deformation to the sheet member or the cap body. The sheet member does not separate when a container is brought to reduced pressure. An annular protruding portion protruding on a lower surface side is formed in an annular flat region of a sheet member of an inside plug. After or at the same time that the sheet member is inserted into and installed at a predetermined position within a cap body, the annular protruding portion is pressed axially toward a top panel wall and deformed so as to become close to a flat shape, to enlarge the outer diameter of the sheet member. The inside plug is thereby held to be
(Continued)

inseparable from inside a skirt wall and to be axially movable.

11 Claims, 14 Drawing Sheets

(51) Int. Cl.

| | |
|---|---|
| ***B23P 11/00*** | (2006.01) |
| ***B21D 39/00*** | (2006.01) |
| ***B65D 43/08*** | (2006.01) |
| ***B65D 39/00*** | (2006.01) |
| ***B21D 51/44*** | (2006.01) |
| ***B21D 51/50*** | (2006.01) |
| ***B65D 53/00*** | (2006.01) |
| ***B21D 51/46*** | (2006.01) |
| ***B65D 41/14*** | (2006.01) |
| ***B65D 41/34*** | (2006.01) |
| ***B21J 5/00*** | (2006.01) |

(52) U.S. Cl.
CPC ..... *B21J 5/00* (2013.01); *B65D 41/145* (2013.01); *B65D 41/34* (2013.01); *B65D 41/348* (2013.01); *B65D 53/00* (2013.01); *Y10T 29/49845* (2015.01)

(58) Field of Classification Search
CPC .... B65D 41/145; B65D 41/348; B21D 51/50; B21D 39/00; B21D 51/46; Y10T 29/49845; B21J 5/00
USPC ..... 29/434, 437, 505, 509; 215/364, 355; 220/780, 789, 801, 802, 803, 804
See application file for complete search history.

(56) References Cited

U.S. PATENT DOCUMENTS 3,612,320 A * 10/1971 Wassilieff ..... B65D 41/0435 215/316
3,771,683 A 11/1973 Dickey
3,842,547 A 10/1974 Belanger
4,114,775 A * 9/1978 Shinozaki ..... B65D 41/0464 206/807
4,205,755 A * 6/1980 de Wijn ..... B21D 51/50 215/252
4,253,580 A * 3/1981 Doi ..... B65D 53/00 215/228
4,395,446 A * 7/1983 Kunimoto ..... B65D 41/12 428/172
4,813,557 A * 3/1989 Herron ..... B65D 41/348 215/329
4,880,127 A * 11/1989 Doi ..... B65D 51/1688 215/252
5,285,913 A * 2/1994 Morton ..... B65D 41/045 215/349
5,762,219 A * 6/1998 Parrinello ..... B65D 41/045 215/341
6,477,823 B1 * 11/2002 Kitterman ..... B65B 7/168 215/344
6,929,137 B1 * 8/2005 Granger ..... B65D 41/045 215/219
7,014,060 B2 * 3/2006 Richardson ..... B65D 51/145 220/288
7,555,927 B2 * 7/2009 Hanafusa ..... B21D 51/2615 72/349
8,002,130 B2 * 8/2011 Thilly ..... B65D 51/002 215/249
8,037,728 B2 * 10/2011 Hosoi ..... B21D 51/2615 72/405.03
2004/0007554 A1 * 1/2004 Ribi ..... B65B 7/165 215/200
2006/0140745 A1 * 6/2006 Buswell ..... B21D 51/46 413/8
2006/0169665 A1 * 8/2006 Matukawa ..... B65D 41/3428 215/252
2007/0034593 A1 * 2/2007 Ichimura ..... B65D 41/045 215/307
2007/0151091 A1 * 7/2007 Babej ..... F16B 37/062 29/509
2008/0073309 A1 * 3/2008 Nakajima ..... B65D 41/045 215/252
2008/0302753 A1 * 12/2008 Jochem ..... B29C 43/18 215/228
2010/0065528 A1 * 3/2010 Hanafusa ..... B65D 41/045 215/347
2015/0020364 A1 * 1/2015 Bonfoey ..... B21D 51/44 29/428

FOREIGN PATENT DOCUMENTS

| | | |
|---|---|---|
| JP | 2007-161313 | 6/2007 |
| JP | 4585126 | 9/2010 |
| JP | 2011-173610 | 9/2011 |
| WO | 94/29186 | 12/1994 |

* cited by examiner (B)

(A)

METHOD FOR MANUFACTURING CAP

TECHNICAL FIELD

This invention relates to a method for manufacturing a cap having a metallic inside plug. More specifically, the invention relates to a method for manufacturing a cap in which a metallic sheet member constituting a part of an inside plug can be inserted smoothly into a cap body and the inserted inside plug can be reliably prevented from separating.

BACKGROUND ART

Generally, a metal cap obtained by forming of a metal sheet, such as an aluminum-based alloy sheet, a chromate-treated steel sheet, or a tinplate sheet, is by far superior in gas barrier properties to a plastic cap. Moreover, the metal cap can be fixed firmly to a container mouth by threaded engagement. Thus, the metal cap is widely used, for example, as a cap for containers of carbonated beverages. So far, one-piece type metal caps formed by supplying molten resin directly into a cap body, followed by compression molding, to carry out forming and placement of a liner simultaneously within the cap body have been put to practical use.

In the above-mentioned one-piece type metal cap, however, when a tamper evident band is formed, the disadvantage occurs that before bridges ensuring connection of the tamper evident band are broken, the sealing of the cap is released. The problem is also posed that compared with a two-piece type cap, the one-piece type cap requires a high stopper-opening torque, and is inferior in unsealing properties.

As a container closure which solves such problems, a proposal has been made for a container closure including a cap body having a circular top panel wall and a cylindrical skirt wall extending downwardly from the peripheral edge of the top panel wall (i.e., a body made of a metal sheet), a metallic sheet member (a reinforcing plate made of a metal sheet), and a synthetic resin liner (Patent Document 1). In this container closure, the sheet member has a circular wall, the liner is disposed on the lower surface of the circular wall, and an inside plug is constituted by the sheet member and the liner. An inner protruding portion protruding radially inwardly is formed in the skirt wall of the cap body, and a free end edge of the sheet member is engaged with the inner protruding portion, whereby the sheet member is restrained within the cap body, with the circular wall of the sheet member being located opposite the inner surface of the top panel wall of the cap body. The container closure of this configuration is formed by a method which comprises integrating the metallic sheet member with the liner, and inserting the resulting composite into the cap body; or a method which comprises inserting the metallic sheet member into the cap body, then supplying molten resin, and press-forming the resin for formation.

PRIOR ART DOCUMENTS

Patent Documents

Patent Document 1: Japanese Patent No. 4585126

SUMMARY OF THE INVENTION

Problems to be Solved by the Invention

The foregoing container closure can solve the aforementioned problems with the conventional metal caps, but has the following problems: In inserting the metallic sheet member into the cap body, assume that the outer diameter of the sheet member is decreased in order to facilitate the insertion. If, in this case, the container is brought to reduced pressure, there may be a trouble such that the inside plug separates from the cap body and remains on the container mouth, or that the container cannot be sealed again. If the outer diameter of the sheet member is increased to prevent the separation of the inside plug, on the other hand, the sheet member or the cap body may be deformed during insertion of the sheet member into a predetermined position of an upper part inside the cap body.

It is an object of the present invention to provide a method for manufacturing a cap having a sheet member constituting a part of an inside plug, the sheet member having an outer diameter such that the sheet member is easily insertible without causing deformation to the sheet member or the cap body when the sheet member is to be installed at a predetermined position of an upper part inside the cap body, and that the sheet member does not separate from the predetermined position of the upper part inside the cap body even when a container is reduced in pressure.

Means for Solving the Problems

According to the present invention, there is provided a method for manufacturing a cap including a cap body and an inside plug, the cap body having a circular top panel wall and a cylindrical skirt wall extending downwardly from the peripheral edge of the top panel wall, the inside plug having a circular metallic sheet member having an annular flat region in an outer peripheral part thereof, and a synthetic resin liner disposed on a lower surface of the sheet member, an inside plug holding protruding portion protruded radially inwardly being formed in an upper end part of the skirt wall of the cap body, wherein an annular protruding portion protruding on a lower surface side or an upper surface side is formed in the annular flat region of the sheet member; and after or at the same time that the sheet member is inserted into and installed in an inside plug holding region above the inside plug holding protruding portion inside the skirt wall of the cap body, the annular protruding portion is pressed in an axial direction of the cap body toward the top panel wall and deformed so as to become close to a flat shape, whereby the outer diameter of the sheet member is enlarged, so that the inside plug is held to be inseparable from inside the skirt wall and to be axially movable between the inside plug holding protruding portion and the inner surface of the top panel wall.

Preferably, the annular protruding portion of the sheet member is either an annular protrusion protruding in a cross-sectionally arched shape on the lower surface side or the upper surface side of the annular flat region, or an annular stepped portion protruding on the lower surface side or the upper surface side and obliquely in a radially outward direction and then extending radially outwardly.

Preferably, at the same time that the sheet member is inserted into and installed in the inside plug holding region inside the skirt wall of the cap body by a setting machine for inserting and installing the sheet member there, the annular protruding portion is pressed by the setting machine in the axial direction toward the top panel wall and deformed so as to become close to a flat shape, whereby the outer diameter of the sheet member is enlarged.

Preferably, when the liner and the sheet member are to be integrally formed by a forming tool which compresses molten resin on the lower surface side of the sheet member inserted into and installed in the inside plug holding region inside the skirt wall of the cap body to form the liner integrally on the lower surface side of the sheet member, the annular protruding portion is pressed by the forming tool in the axial direction toward the top panel wall and deformed so as to become close to a flat shape, whereby the outer diameter of the sheet member is enlarged.

Preferably, the outer peripheral part of the sheet member has a peripheral edge part region including a circular peripheral end edge and the annular flat region continuing radially inwardly from the peripheral edge part region, the peripheral edge part region is composed of a peripheral edge curved portion curved on the lower surface side from the peripheral edge of the annular flat region such that the peripheral end edge faces the lower surface side, and the peripheral end edge of the peripheral edge curved portion defines the peripheral end edge of the sheet member.

Preferably, at the same time that or after the annular protruding portion is pressed in the axial direction toward the top panel wall and deformed so as to become close to a flat shape, whereby the outer diameter of the sheet member is enlarged, the peripheral edge curved portion is pressed from the lower surface side in the axial direction toward the top panel wall and forced open radially outwardly, whereby the outer diameter of the sheet member is further enlarged.

It is preferred that the cap body be composed of a metal sheet, a plurality of openings be formed at circumferentially spaced intervals in an upper end part of the skirt wall of the cap body, each of the openings be formed by protruding radially inwardly a lower region along a cutting line engraved in a circumferential direction in the skirt wall, and the inside plug holding protruding portion be defined by the lower region.

According to the present invention, there is also provided a method for manufacturing an inside plug-equipped cap comprising a cap body formed with a circular top panel wall and a skirt wall, and an inside plug having a circular metallic sheet member and a resin liner formed on an inner surface side of the sheet member, wherein simultaneously with or after insertion of the sheet member into the cap body, an outer peripheral edge part of the sheet member is forced open, whereby the inside plug is held by a support portion formed on an inner side of an upper part of the skirt wall in such a manner as to be inseparable from the cap body and movable upward and downward at a predetermined position above the support portion.

According to the method for manufacturing the cap of the present invention, it is preferred that when the resin liner and the sheet member are to be integrally formed by compressing molten resin on the inner surface side of the sheet member, the outer peripheral edge part of the sheet member be forced open.

In the present invention, it is preferred that the cap body be composed of a metal, a plurality of openings be formed at circumferentially spaced intervals in an upper end part of the skirt wall, and the support portion be formed along the openings by protruding radially inwardly a lower region along a cutting line engraved in the skirt wall.

With the present invention, it is preferred that the shape of the front end surface of a pressing sleeve pressing the outer peripheral edge part of the sheet member be rendered identical with the shape of a part of the forced-open sheet member in contact with the front end surface.

Effects of the Invention

In the method for manufacturing a cap according to the present invention, the metallic sheet member of the inside plug can be inserted into and installed at the predetermined position of the upper part of the interior of the cap body, without deformation of the sheet member or the cap body. Moreover, after insertion and installation of the sheet member, the outer diameter of the sheet member can be enlarged easily and reliably as desired. Even if the interior of the container is under reduced pressure, therefore, the inside plug does not separate from the predetermined position of the upper part inside the cap body.

In the method for manufacturing a cap according to the present invention, at the same time that the metallic sheet member is inserted into and installed in the cap body, the outer diameter of the sheet member can be enlarged easily and reliably as desired. Thus, the number of the steps for manufacturing is small, and productivity and economy are excellent.

The cap equipped with the inside plug having the metallic sheet member, which is obtained by the manufacturing method according to the present invention, has the inside plug, as a separate body, on the inner surface side of the top panel wall. Thus, a stopper opening torque necessary for stopper opening can be reduced, and even the elderly or women or children can easily unstop the cap with slight force. Moreover, the cap is excellent in gas barrier properties, thus effectively preventing the deterioration of contents due to oxygen permeation, the escape of a gas of a carbonated beverage or the like to the outside of the container, and so on.

According to the manufacturing method of the present invention, moreover, the shape of the front end surface of the pressing sleeve pressing the outer peripheral edge part of the sheet member is rendered the same as the shape of a part of the forced-open sheet member in contact with the front end surface. Consequently, the shape of the sheet member after being forced open can be retained stably.

MODE FOR CARRYING OUT THE INVENTION

Figure 1:
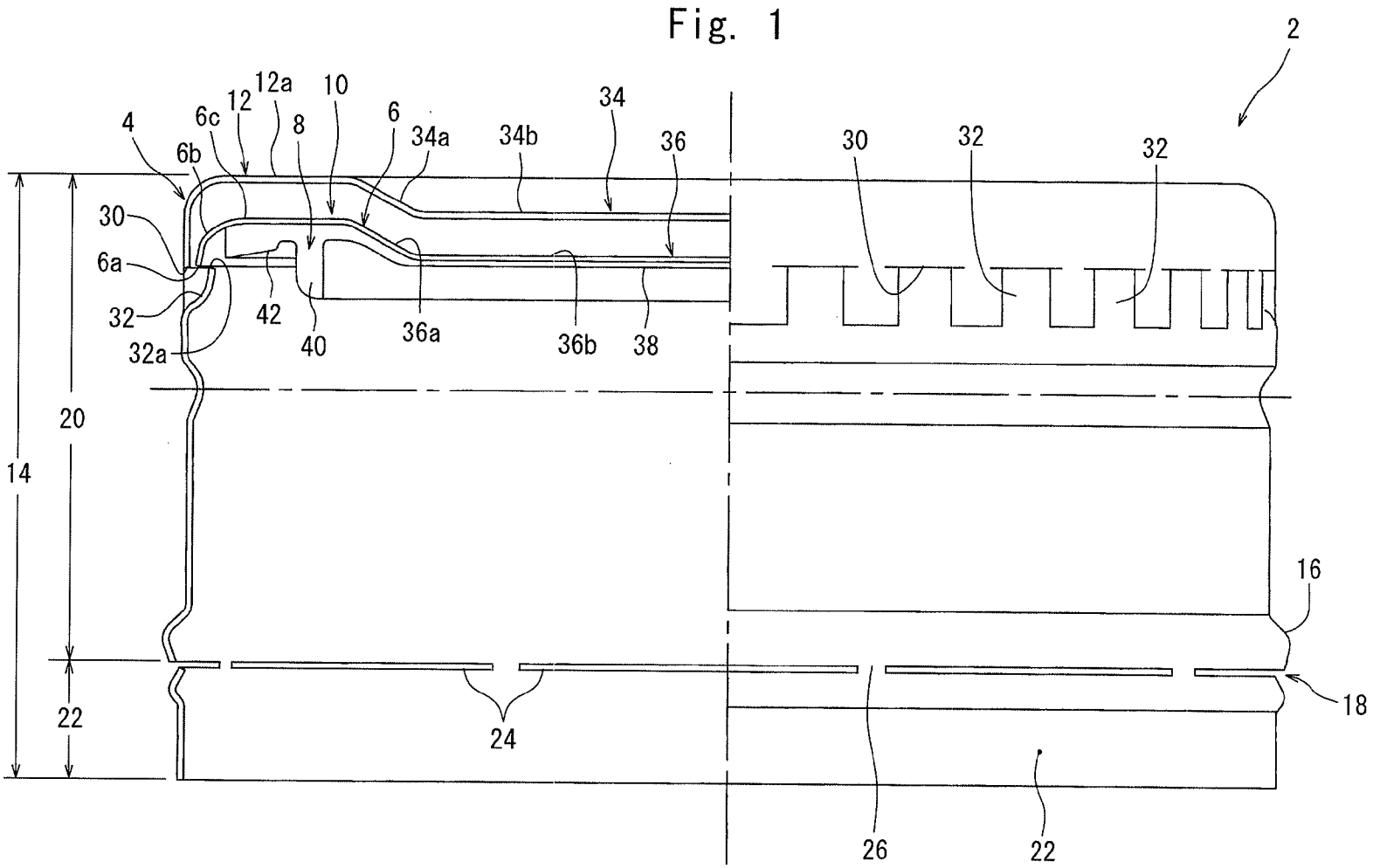
FIG. 1 is a side view showing, partly in section, a metal cap formed using a first embodiment of a method for manufacturing a cap according to the present invention.

A first embodiment of a method for manufacturing a cap according to the present invention will now be described in detail by reference to the accompanying drawings. It should be noted that the terms showing an upward direction and a downward direction about the cap (for example, an upper surface, a lower surface, above, below, upward, downward, an upper end, a lower end, etc.), which are used in connection with the posture of the cap shown in FIGS. 1 and 15(A) to 15(C), are used consistently to represent exactly the same directions as used for the posture of the cap shown in FIGS. 1 and 15(A) to 15(C), even in the drawings showing a manufacturing process involving a posture in which the constituent members of the cap have been turned upside down. For example, the "lower surface" of the "top panel wall" in the posture of the cap shown in FIG. 1 is an "upper surface" in the posture of the cap shown in FIG. 2. However, in order to avoid an complicated explanation, the term "lower surface" as used in the posture of the cap shown in FIG. 1 is used consistently. The direction of a device or the like free from an explanation for the cap is not inverted, even when the cap is vertically inverted.

First, with reference to FIG. 1, a metal cap produced by the manufacturing method according to the present invention will be described. The cap, entirely indicated at 2, is composed of a metal cap body 4, and an inside plug 10 consisting of a circular metallic sheet member 6 and a synthetic resin liner 8. The cap body 4 has a circular top panel wall 12, and a cylindrical skirt wall 14 extending downwardly from the peripheral edge of the top panel wall. An annular bulging-out portion 16 somewhat bulged radially outwardly is formed in a lower part of the skirt wall 14. A breakage line 18 is formed in a circumferential direction in an axially central part of the annular bulging-out portion 16. The skirt wall 14 is divided into a main section 20 above the breakage line 18, and a tamper evident band 22 below the breakage line 18. The breakage line 18 is composed of a plurality of slits 24 extending in the circumferential direction at circumferentially spaced intervals, and a plurality of bridge portions 26 located between the slits 24 so as to be breakable.

Figure 2:
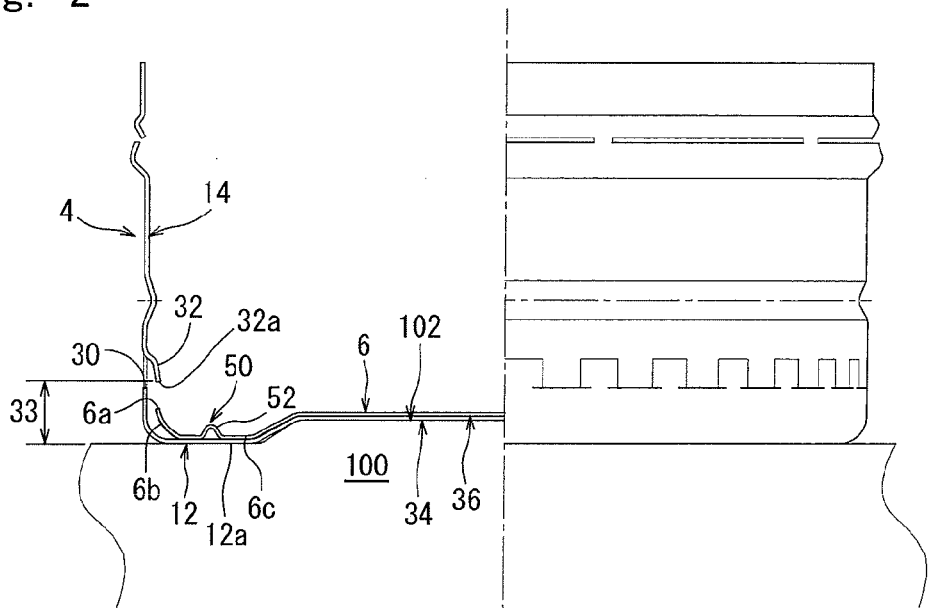
FIG. 2 is a side view showing, partly in section, a state where a sheet member has been installed in a cap body of the cap in FIG. 1.

On the upper end side of the skirt wall 14, inside plug holding protruding portions 32 are formed in an inner peripheral surface of the main section 20, and a region above the inside plug holding protruding portions 32 within the cap body 4 (the region ranging up to the inner surface of the top panel wall 12) constitutes an inside plug holding region 33 (FIG. 2).

In the first embodiment and second to fifth embodiments to be described later, the inside plug holding protruding portions 32 are formed on the upper end side of the skirt wall 14 by protruding radially inwardly a region below a cutting line engraved in the circumferential direction, and the cutting line at the upper ends of the inside plug holding protruding portions 32 serves to define openings 30 extending substantially horizontally. An axial section of a circumferentially central part of the inside plug holding protruding portion 32 extends in an upwardly gently curved manner from the skirt wall toward the radial inside, and the upper end of the axial section defines a cut free end edge 32*a*. The openings 30 are provided for releasing a pressure abnormally raised within a container, or for flowing water used to wash the outer peripheral surface of a mouth-and-neck portion of the container. The outer diameter of the sheet member 6 is rendered slightly larger than the inner diameter of a virtual circle passing the radially inward end of each of the inside plug holding protruding portions 32. The inside plug holding protruding portions 32 restrain the sheet member 6 so as not to be separable from within the inside plug holding region 33, and hold the inside plug so as to be axially movable (loosely fittable) within the holding region 33. A threaded region is present in the skirt wall main section 20 below the inside plug holding protruding portions 32.

In a central part of the lower surface of the top panel wall 12 of the body 4, a body convexity 34 for positioning the inside plug 10 coaxially is formed to bulge downward. That is, the body convexity 34 is composed of a body annular inclined portion 34*a* extending radially inwardly and downwardly from the inner peripheral edge of a flat annular peripheral edge region 12*a* present on the outer peripheral side of the top panel wall 12, and a body disk portion 34*b* extending from the lower end of the body annular inclined portion 34*a* in a flat form parallel to the annular peripheral edge region 12*a*.

In the illustrated embodiment, an outer peripheral part of the sheet member 6 includes an annular flat region 6*c* orthogonal to the axial line, a peripheral edge curved portion 6*b* arcuately drooping radially outwardly and downwardly from the outer peripheral edge of the annular flat region 6*c*, and a circular (ring-shaped) peripheral end edge 6*a*. The upper surface of a central part of the sheet member 6 is concave toward the lower side of the cap 2 to form an inside plug concavity 36 which is brought into intimate contact and alignment with the body convexity 34 from the lower surface side and positioned coaxially. The inside plug concavity 36 is composed of an inside plug annular inclined portion 36*a* extending inwardly and toward the lower surface side from the inner peripheral edge of the annular flat region 6*c* of the sheet member 6, and a flat inside plug disk portion 36*b* present in a plane extending from the lower end of the inclined portion 36*a* toward the center of the sheet member 6 so as to be orthogonal to the axial line.

Next, the concrete shape of the annular protruding portion of the cap 2 according to the present embodiment will be described by reference to FIG. 2. In the annular flat region 6*c* of the sheet member 6 serving as the inside plug of the cap of the present invention, an annular protruding portion 50 protruding downward is formed by a suitable pressing machine. In FIG. 2, the annular protruding portion 50 is composed of a single annular protrusion 52 protruding in a cross-sectionally arched shape on the lower surface side of the annular flat region 6*c*. The cross-sectionally arched shape does not mean a strict arched shape, but is assumed to include various embodiments, such as those whose sectional shapes are a shape like a parabola, a modified shape of a parabola asymmetric in the X-axis direction, and a shape like a trapezoid. In the embodiment of FIG. 2, the annular protruding portion 50 is the single protrusion protruding on the lower surface side, but may be a plurality of them. That is, the shape of the annular protruding portion may be any shape floating above the inner surface of the annular peripheral edge region of the top panel wall to create a space, in the annular flat region 6*c*. Such a shape, when pressed to collapse, can enlarge the diameter of the peripheral end edge 6*a*, thereby attaining the object of the invention.

Figure 3:
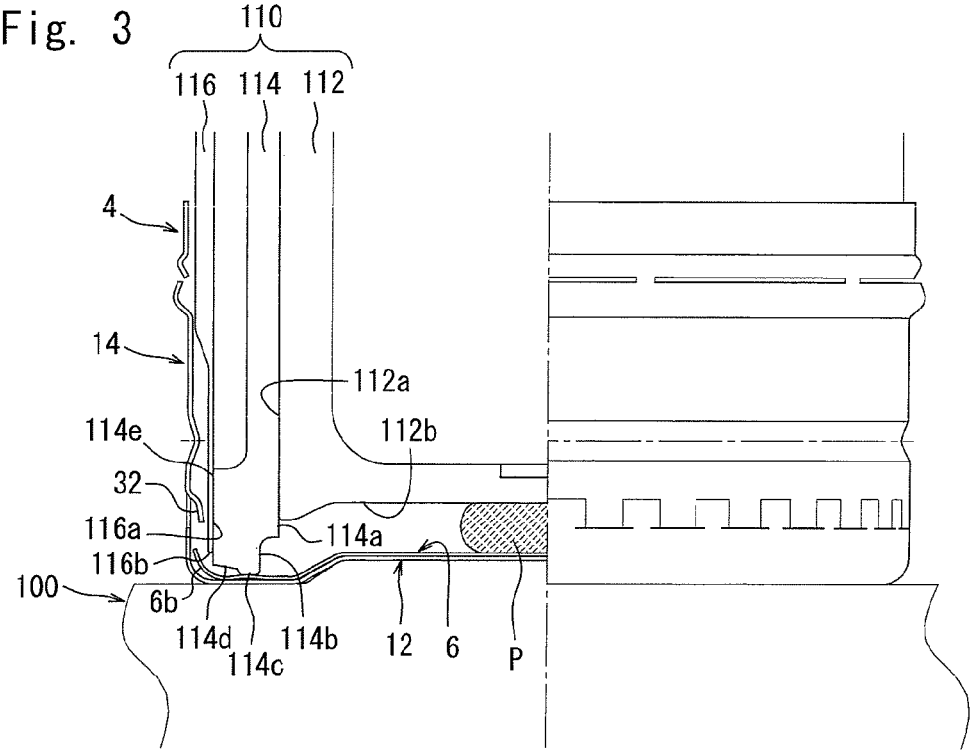
FIG. 3 is a side view showing, partly in section, a state where an annular protruding portion of the cap in FIG. 1 is being pressed by a forming tool.
Figure 4:
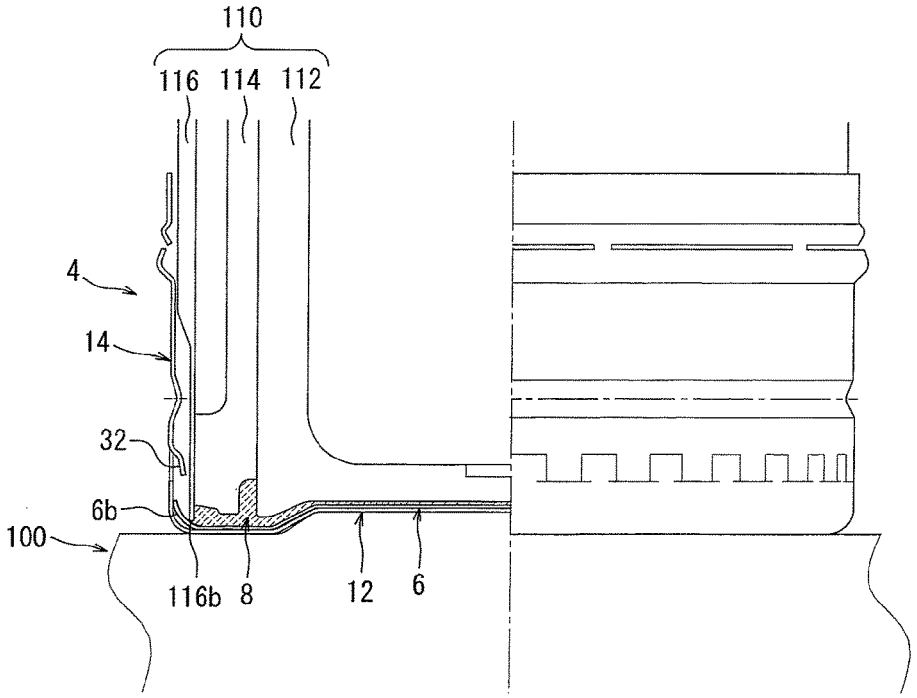
FIG. 4 is a side view showing, partly in section, a state where a synthetic resin liner has been press-formed by the forming tool, starting in the state of FIG. 3.

Once the cap body 4 and the sheet member 6 thus far explained have been formed, the sheet member 6 is inserted into the body 4, and the liner 8 is formed in the sheet member 6 to produce the inside plug 10. In order to insert the sheet member 6 into the body 4, the cap body 4 is installed, with its opening end directed upward, such that the top panel wall 12 contacts the upper surface of a forming stand 100, as shown in FIGS. 2 to 4. A convexity 102 (FIG. 2) is formed on the upper surface of the forming stand 100, and the convexity 102 is formed to align with the aforementioned body convexity 34. Since the body convexity 34 is fitted onto the convexity 102 from above nearly in intimate contact, the body 4 is installed stably at a predetermined position of the forming stand 100. An upper surface region of the forming stand 100 surrounding the peripheral edge of the convexity 102 is formed into a flat surface and, on this flat surface, the upper surface of the annular peripheral edge region 12*a* of the cap body 4 is placed in contact therewith.

Then, using a setting machine 200 to be described later (see FIG. 9), the sheet member 6 having the annular protruding portion 50 formed therein is forcibly inserted into the inside plug holding region 33 after being allowed to climb over the inside plug holding protruding portion 32 of the cap body 4. As stated earlier, the outer diameter of the sheet member 6 is rendered slightly greater than the inner diameter of the inside plug holding protruding portion 32. Thus, when the peripheral end edge 6*a* of the sheet member 6 passes the inside plug holding protruding portion 32, during insertion, the inside plug holding protruding portion 32 is elastically displaced radially outwardly or the peripheral edge curved portion 6*b* of the sheet member 6 is elastically displaced radially inwardly. Because of a slight difference between the diameters, however, the inside plug holding protruding portion 32 and the sheet member 6 are not plastically deformed.

When the sheet member 6 is inserted into the inside plug holding region 33 with the use of the setting machine 200 (see FIG. 10), the upper surface of the sheet member 6 is located opposite the inner surface of the top panel wall 12 of the cap body 4. The inside plug concavity 36 is brought into intimate contact and alignment with the body convexity 34 from the lower surface side, with the result that the sheet member 6 is positioned and installed coaxially with the cap body 4. Thus, operations for forming the liner 8 and enlarging the outer diameter of the sheet member 6 which will be described later can be performed with ease and with high accuracy.

In the present invention, the following actions are important: After the sheet member 6 is inserted into the inside plug holding region 33 of the cap body 4, namely, after the peripheral end edge 6*a* moves upward and passes the inside plug holding protruding portion 32, the annular protruding portion 50 of the sheet member 6 is pressed toward the top panel wall 12 and pinched between the forming stand 100 and a forming tool 110, whereby the annular protruding portion 50 is deformed into a flat shape to enlarge the outer diameter of the sheet member 6.

The synthetic resin liner 8 is disposed on the lower surface of the sheet member 6 subjected to a liner formation step to be described later. The synthetic resin liner 8, which can be formed by press-forming a suitable synthetic resin material such as low density polyethylene, is disk-shaped as a whole. The synthetic resin liner 8 has a thin-walled central portion 38, an inner ring 40 formed in a peripheral edge part of the thin-walled central portion 38, and an annular sealing surface 42 extending radially outwardly from the inner ring 40.

The liner formation step will be described by reference to FIGS. 3 and 4. The forming tool 110 for integrally forming the liner 8 on the lower surface side of the sheet member 6 includes a central punch 112, an intermediate pressing sleeve 114, and a peripheral edge positioning sleeve 116, each made of a metal. The central punch 112 is fitted to the inner peripheral surface 114*a* of the intermediate pressing sleeve 114 so as to be relatively movable in the axial direction, and is provided with an outer peripheral surface 112*a* having a shape corresponding to the inner peripheral surface of the inner ring 40 and a lower surface 112*b* having a shape corresponding to the thin-walled central portion 38. The intermediate pressing sleeve 114 has, in a lower end part thereof, an inner peripheral surface 114*a*, an annular curved surface 114*b*, an annular flat lower surface 114*c*, an annular inclined lower surface 114*d*, and an outer peripheral surface 114*e*. The inner peripheral surface 114*a* is fitted to the outer peripheral surface 112*a* of the central punch 112 so as to be relatively movable in the axial direction. The annular curved surface 114*b* has a shape corresponding to the lower surface and outer peripheral surface of the inner ring 40. The annular flat lower surface 114*c* has a shape corresponding to an annular flat lower surface extending radially outwardly in a flat form from the upper end of the outer peripheral surface of the inner ring 40. The annular inclined lower surface 114*d* has a shape corresponding to the sealing surface 42 and extending radially outwardly in a downwardly inclined manner from the annular flat lower surface 114*c* and then extending radially outwardly in a less inclined manner than in the above manner of inclination. The outer peripheral surface 114*e* is fitted to the inner peripheral surface 116*a* of the peripheral edge positioning sleeve 116 so as to be relatively movable in the axial direction. The peripheral edge positioning sleeve 116 has the inner peripheral surface 116*a* fitted to the outer peripheral surface 114*e* of the intermediate pressing sleeve 114 so as to be relatively movable in the axial direction, a lower end surface 116*b* contacting the sheet member 6, and an outer peripheral surface 116*c*.

Next, an explanation will be offered for the step of forming the liner by the forming tool.

After supply of molten resin P, the forming tool 110 is inserted inside the skirt wall 14, and lowered toward the forming stand 100 to position the annular flat lower surface 114*c* of the intermediate pressing sleeve 114 at the lowermost end. As a result, the annular flat lower surface 114*c* of the intermediate pressing sleeve 114 presses the annular protrusion 52 of the sheet member 6 axially against the top panel wall 12 to deform the annular protrusion 52. Thus, the outer diameter of the sheet member 6 is enlarged.

Then, the central punch 112 and the peripheral edge positioning sleeve 116 are both lowered. The lower end surface 116*b* of the peripheral edge positioning sleeve 116 is brought into contact with the lower surface of the annular flat region of the sheet member 6 or the lower surface of the peripheral edge curved portion 6*b* before the lower surface 112*b* of the central punch 112 makes such contact, whereby the descent of the peripheral edge positioning sleeve 116 is stopped. Then, the central punch 112 is further lowered to a predetermined position, as shown in FIG. 4. At this time, the molten resin P is compressed, and the intermediate pressing sleeve 114 is raised by the pressure of the molten resin P, whereby the liner 8 is integrally formed on the lower surface of the sheet member 6. The peripheral edge positioning sleeve 116 defines the peripheral edge of the liner 8 so that the molten resin P does not leak out during integral formation.

Figure 5:
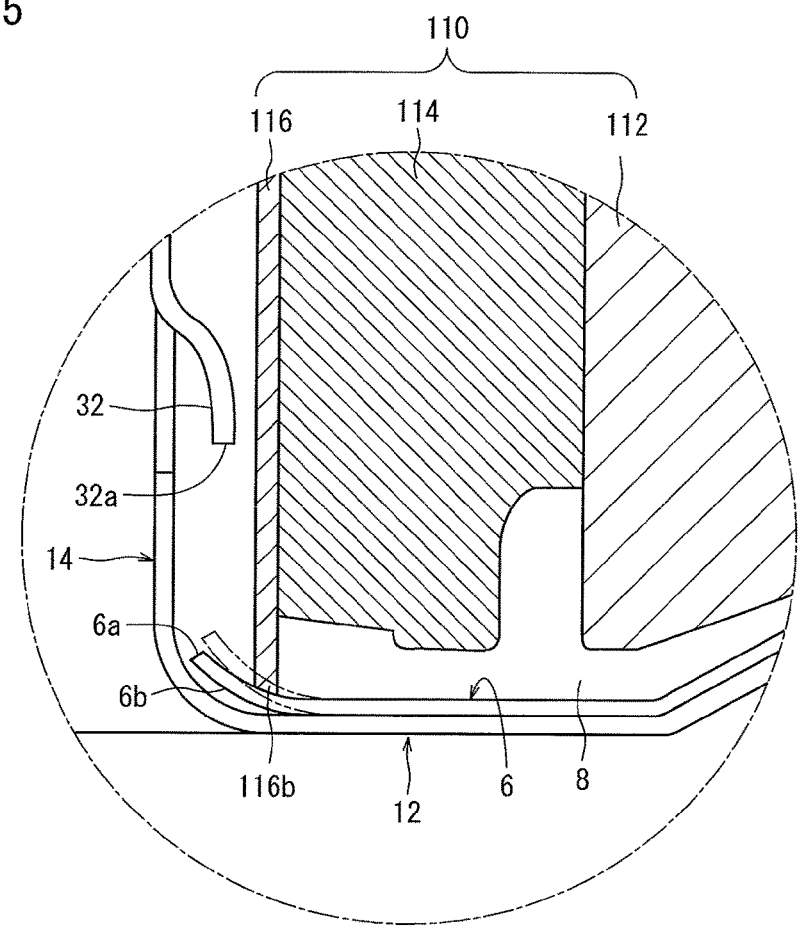
FIG. 5 is an enlarged sectional view of essential parts of a cap and a forming tool according to a second embodiment of the method for manufacturing a cap concerned with the present invention.

Next, a second embodiment of the method for manufacturing a cap according to the present invention will be described by reference to FIG. 5.

In the above first embodiment, the peripheral edge positioning sleeve 116 is brought into contact with the lower surface of the sheet member 6, and its descent is stopped. In the present embodiment, on the other hand, even when the lower end surface 116*b* of the peripheral edge positioning sleeve 116 is contacted with the lower surface of the peripheral edge curved portion 6*b* of the sheet member 6, it is further lowered. As a result, in addition to the deformation of the annular protrusion 52 (see FIG. 2), the peripheral edge curved portion 6*b* is pressed axially toward the top panel wall 12, whereby the peripheral end edge 6*a* can be forced open radially outwardly, and the outer diameter of the sheet member 6 can be further enlarged. In FIG. 5, a dashed double-dotted line represents the shape of the peripheral edge curved portion 6*b* before being forced open, while a solid line represents its shape after forcing-open. According to this embodiment, the amount of protrusion of the annular protrusion 52 can be decreased to facilitate processing and deformation.

In the previous explanation, moreover, after the annular protrusion 52 is deformed by the intermediate pressing sleeve 114, the peripheral edge positioning sleeve 116 is lowered to force the peripheral edge curved portion 6*b* open. Instead, the intermediate pressing sleeve 114 and the peripheral edge positioning sleeve 116 may be simultaneously lowered to press and deform the annular protrusion 52 and the peripheral edge curved portion 6*b* at the same time.

In the present embodiment, when the peripheral edge curved portion 6*b* is pressed in the axial direction by the lower end surface 116*b* of the peripheral edge positioning sleeve 116, the shape of the lower end surface 116*b* is rendered the same as the shape of the lower surface of the peripheral edge curved portion 6*b* which is after being forced-open and with which the lower end surface 116*b* is contacted. This configuration enables the shape of the peripheral edge curved portion 6*b* after being forced open to be retained stably.

The parts whose explanations have been omitted are the same as in the aforementioned first embodiment.

Next, a third embodiment of the method for manufacturing a cap according to the present invention will be described.

Figure 6:
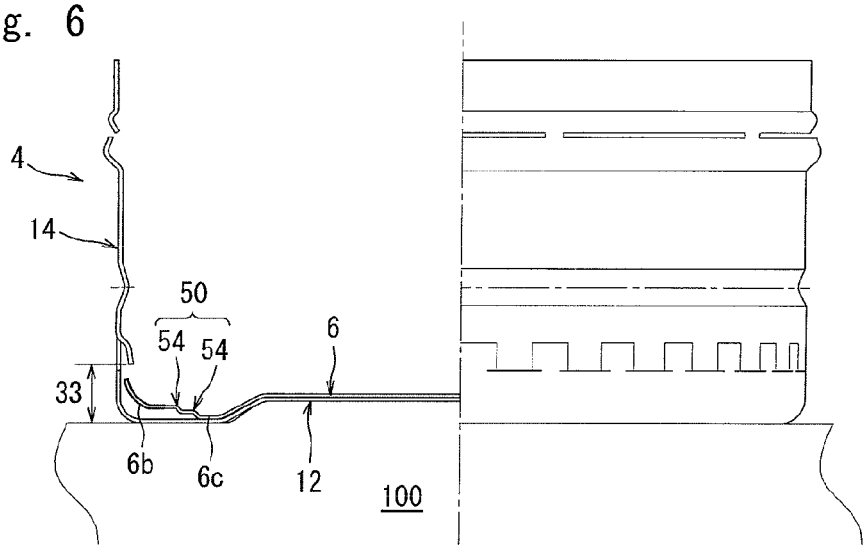
FIG. 6 is a side view showing, partly in section, a state where a sheet member of a third embodiment of the method for manufacturing a cap according to the present invention has been installed within the cap body.

FIG. 6 shows a state where a sheet member 6 provided with an annular protruding portion 50 of the present embodiment has been installed. In this embodiment, the annular protruding portion 50 has an annular stepped portion 54 protruding in an inclined manner downwardly and radially outwardly from a central part of an annular flat region 6*c* and then extending radially outwardly parallel to the flat region, and further has another annular stepped portion 54 protruding in an inclined manner downwardly and radially outwardly and then extending radially outwardly parallel to the flat region. Aside from the illustrated embodiment, there may be one such stepped portion, three such stepped portions, or the like. In other words, the shape of the annular protruding portion 50 can be changed variously, if it is such a shape as to be pressable by the flat lower surface 114*c*.

Figure 7:
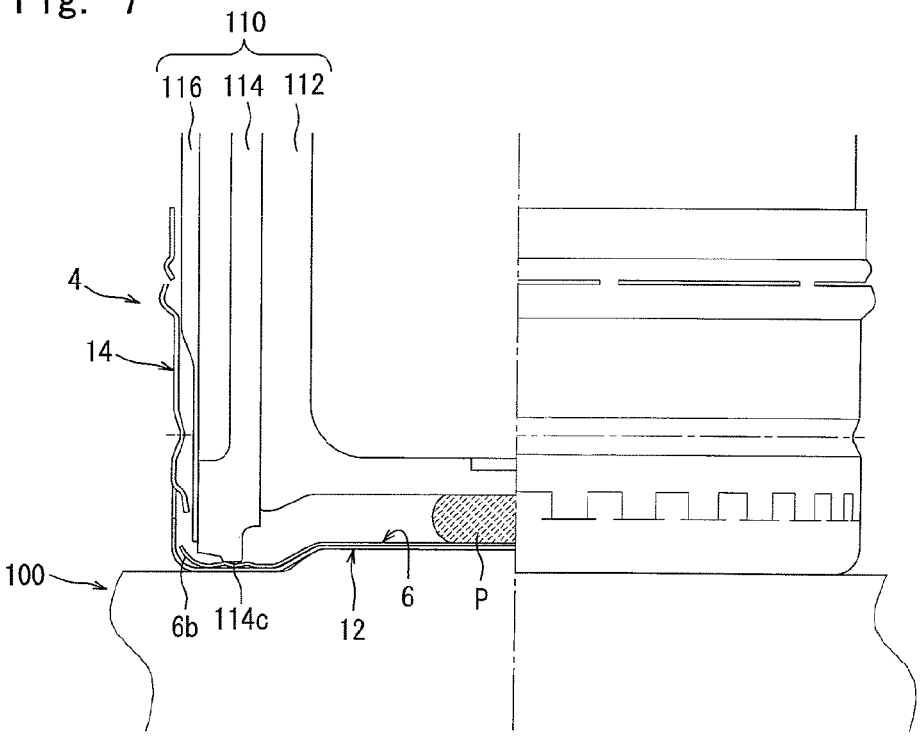
FIG. 7 is a side view of a state where an annular protruding portion of FIG. 6 is being pressed by a forming tool.
Figure 8:
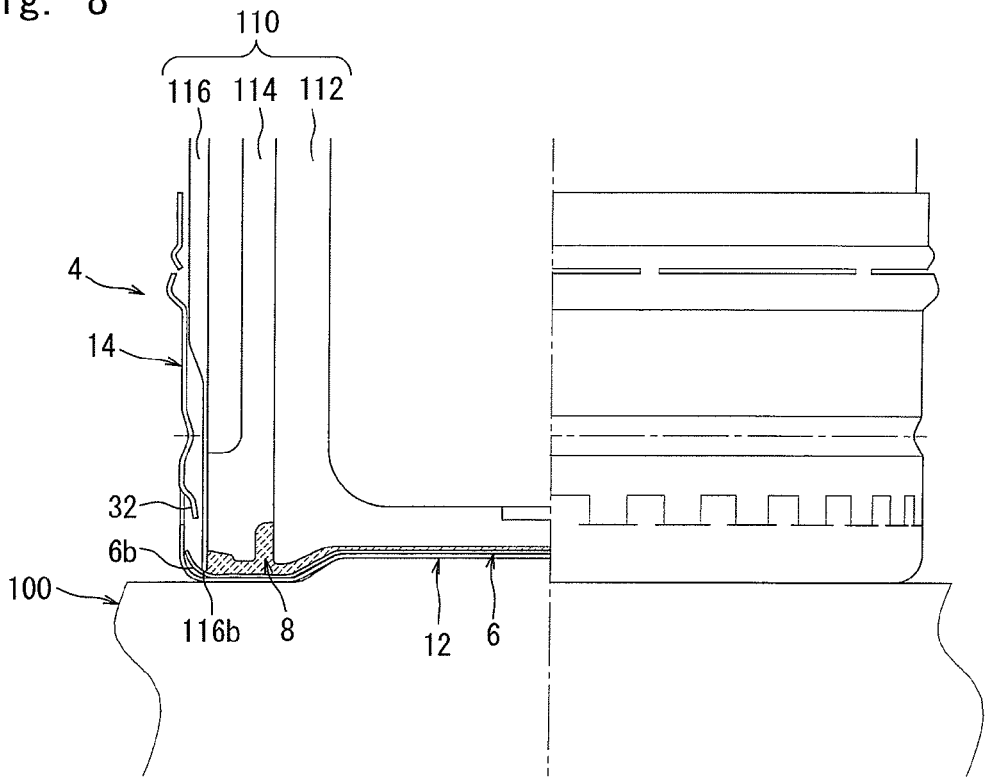
FIG. 8 is a side view showing, partly in section, a state where a synthetic resin liner has been press-formed by the forming tool of FIG. 7.

FIG. 7 shows a state where after molten resin P is supplied to a central part of the lower surface of the sheet member 6 shown in FIG. 6, the forming tool 110 is inserted inside the skirt wall 14 of the cap body 4 to deform each of the annular stepped portions 54 of the sheet member 6 by the annular flat lower surface 114*c* of the intermediate pressing sleeve 114 so as to become close to a flat shape, thereby enlarging the outer diameter of the sheet member 6. FIG. 7 shows the same state as that shown in FIG. 3. FIG. 8 shows a state where after the outer diameter of the sheet member 6 is enlarged in FIG. 7, the forming tool 110 is allowed to act on the molten resin P supplied to the lower surface of the sheet member 6 to press-form the synthetic resin liner 8 on the lower surface of the sheet member 6. FIG. 8 shows the same state as that shown in FIG. 4. As will be clear from the above explanations, even the present embodiment, in which the annular protruding portion 50 is composed of the annular stepped portions 54 shown in FIG. 6, achieves substantially the same action and effect as those in the aforementioned first embodiment.

Next a fourth embodiment of the method for manufacturing a cap according to the present invention will be described.

FIGS. 9 to 13 present concrete manufacturing steps involved in the embodiment of the method for manufacturing a cap according to the present invention. In the present embodiment, the sheet member 6 is installed by the setting machine 200 which installs it in the inside plug holding region 33. At the same time, the annular protruding portion 50 is pressed by the setting machine 200 axially toward the top panel wall 12, and pinched between the forming stand 100 and the setting machine 200. By this procedure, the annular protruding portion 50 is deformed into a flat shape to enlarge the outer diameter of the sheet member 6. In this embodiment, the annular protruding portion 50 is composed of the two annular stepped portions 54. It goes without saying that even the annular protruding portion 50 of a different shape as explained in the aforementioned embodiment can be similarly pressed using the setting machine to enlarge the outer diameter of the sheet member 6.

Figure 9:
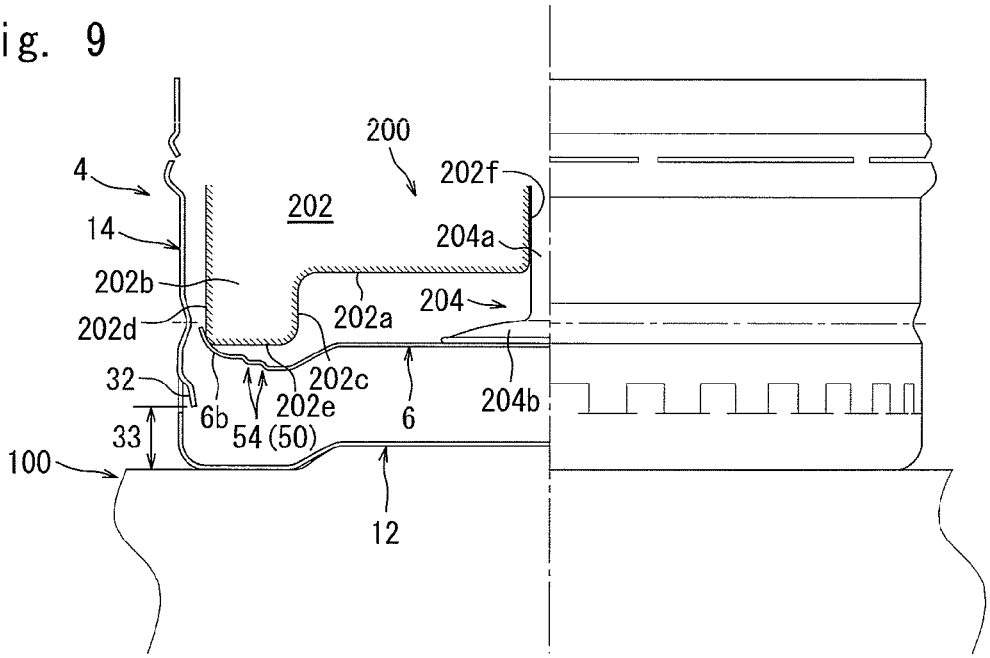
FIG. 9 is a side view showing, partly in section, a state before a sheet member of the same shape as in FIG. 6 is sucked and inserted into an inside plug holding region by a setting machine in a fourth embodiment of the present invention.

The shape of the setting machine 200 will be described with reference to FIG. 9. The setting machine 200 has a setting machine body 202 and a suction tool 204. The metallic setting machine body 202 has a cylindrical lower end part, and the lower end part is composed of a circular lower surface 202*a* having in the center a penetrating hole 202*f* open for passing therethrough the suction tool 204, and a cylindrical protrusion 202*b* extending out axially downwardly from the peripheral edge of the circular lower surface 202*a*. The cylindrical protrusion 202*b* has an inner peripheral surface 202*c*, an outer peripheral surface 202*d*, and a lower end surface 202*e*. Corners, at which the lower end surface 202*e* intersects the inner peripheral surface 202*c* and also intersects the outer peripheral surface 202*d*, each form an arcuately curved surface. The circular lower surface 202*a* is formed to be parallel to the inside plug disk portion 36*b*, and the lower end surface 202*e* is formed to be parallel to the inner peripheral surface of the peripheral edge region 12*a* of the cap body 4.

The suction tool 204 includes a synthetic resin or metal pipe 204*a* extending linearly, and a suction cup 204*b* of synthetic rubber integrally formed at the lower end of the pipe 204*a*. At the center of the setting machine body 202, the penetrating hole 202*f* extending along the axial line is formed. The pipe 204*a* is inserted into and supported by the penetrating hole 202*f* of the setting machine body 202 so as to be relatively movable. A lower end part of the pipe 204*a* protrudes below the circular lower surface 202*a* and, at its lower end, the suction cup 204*b* is positioned below the circular lower surface 202*a*. An upper end part (not shown) of the pipe 204*a* is connected to a suction source (not shown). The sheet member 6 has a central part sucked and held by the suction cup 204*b* of the setting machine 200, and is inserted into the cap body 4 installed on the forming stand 100.

Figure 10:
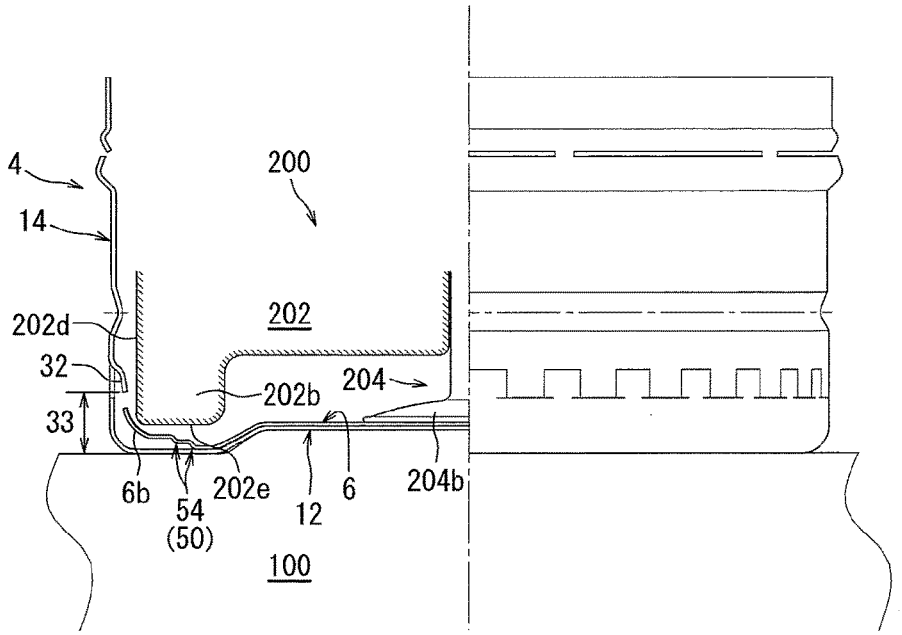
FIG. 10 is a side view showing, partly in section, a state where the sheet member has been completely inserted into the inside plug holding region by the setting machine, starting in the state of FIG. 9.

FIG. 10 shows a state where the sheet member 6 has been completely inserted into the inside plug holding region 33 of the cap body 4. The inner peripheral surface of the peripheral edge curved portion 6*b* of the sheet member 6 is brought into contact with the arcuate corner where the lower end surface 202*e* and the outer peripheral surface 202*d* of the setting machine body 202 intersect. The lower end surface 202*e* of the cylindrical protrusion 202*b* of the setting machine body 202, on the other hand, is positioned to be spaced from the lower surface of each of the annular stepped portions 54 of the sheet member 6.

Figure 11:
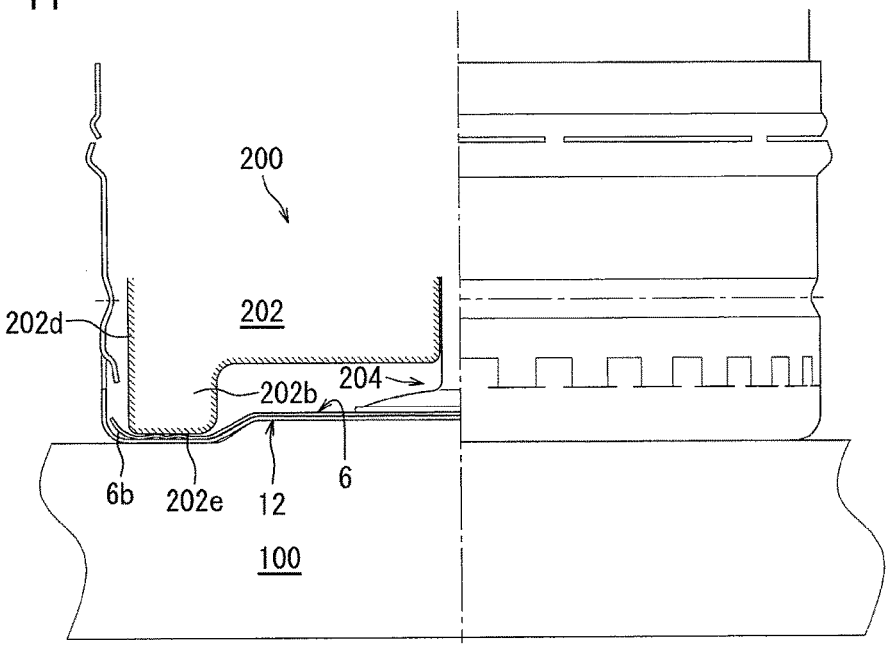
FIG. 11 is a side view showing, partly in section, a state where the body of the setting machine has been further lowered from the state of FIG. 10 to press the annular protruding portion.

When the setting machine body 202 is further lowered from the state shown in FIG. 10, a state shown in FIG. 11 is created. As shown in FIG. 11, the arcuate corner where the lower end surface 202*e* and the outer peripheral surface 202*d* of the setting machine body 202 intersect presses the peripheral edge curved portion 6*b* axially toward the top panel wall 12 to force the peripheral end edge 6*a* open radially outwardly. Furthermore, the lower end surface 202*e* presses each of the annular stepped portions 54 of the sheet member 6 axially against the top panel wall 12 to deform the annular stepped portions 54 into a flat shape, thereby enlarging the outer diameter of the sheet member 6. As a result, the outer diameter of the sheet member 6 can be further enlarged.

In the present embodiment, the setting machine 200 acts on both of the annular stepped portions 54 and the peripheral edge curved portion 6*b* to enlarge the outer diameter of the sheet member 6. However, there may be an embodiment in which the setting machine 200 acts only on each of the annular stepped portions 54, if the outer diameter of the sheet member can be enlarged sufficiently. Alternatively, the shape of the annular protrusion 52 can be used instead of the shape of the annular stepped portion 54.

Figure 12:
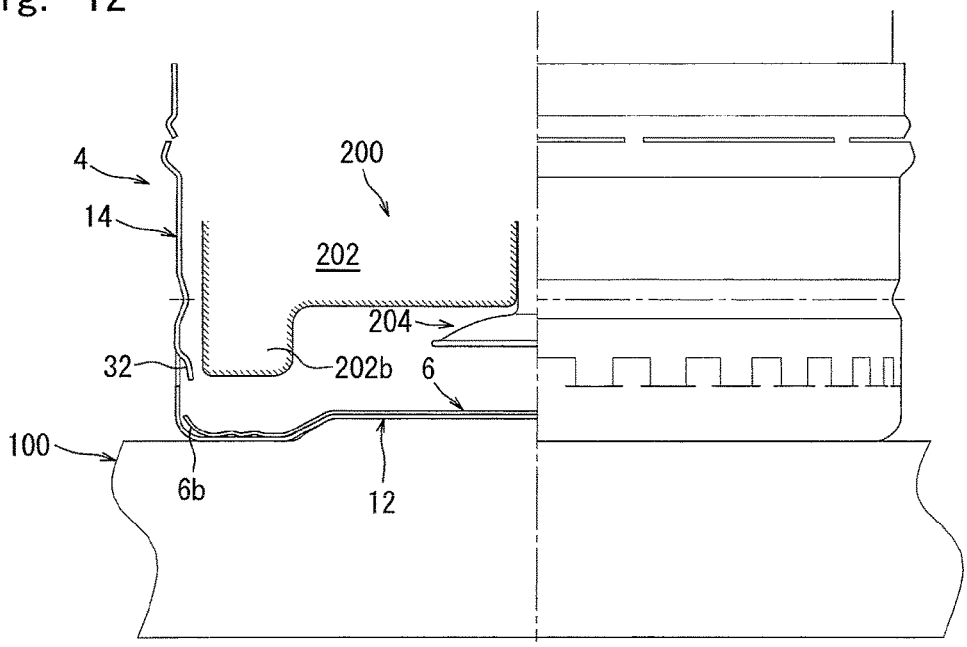
FIG. 12 is a side view showing, partly in section, a state after the suction of the sheet member by a suction tool of the setting machine has been released from the state of FIG. 11.
Figure 13:
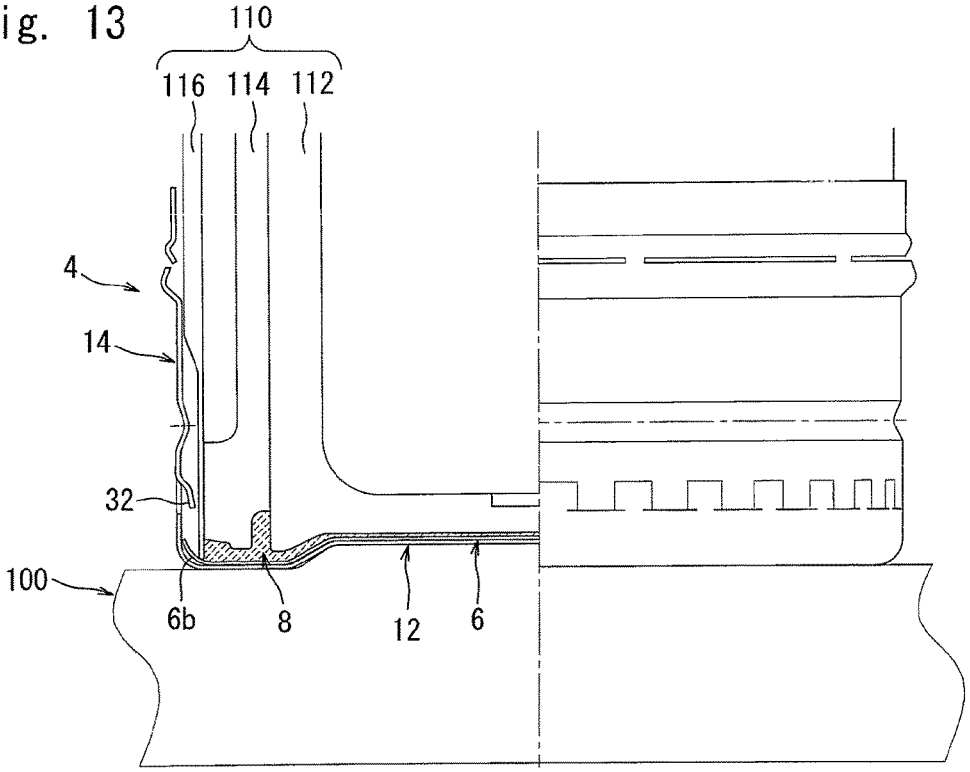
FIG. 13 is a side view showing, partly in section, a state where after removal of the setting machine of FIG. 12, a forming tool for molten resin has been operated to press-form a synthetic resin liner.

Then, the suction of the sheet member 6 by the suction tool 204 of the setting machine 200 is released, whereafter the setting machine 200 is withdrawn from inside the skirt wall 14 of the cap body 4 (see FIG. 12).

After the setting machine 200 is completely withdrawn from inside the skirt wall 14 of the cap body 4 (not shown), molten resin P is supplied to the central part of the lower surface of the sheet member 6 (see FIG. 3), and the forming tool 110 is allowed to act on the molten resin P, thereby press-forming the synthetic resin liner 8 on the lower surface of the sheet member 6 (see FIG. 4).

After the protruding portion 50 is deformed by the setting machine 200, there is no need to further spread out the protruding portion 50 when press-forming the liner. However, as will be described later, by pressing the annular protruding portion 50 again, it takes a further flat shape, whereby the outer diameter of the inside plug can be enlarged. By so doing, separation of the inside plug can be reliably prevented, and it can also be expected for sealing performance to become satisfactory.

Conversely, if it is scheduled to perform the step of pressing and deforming the protruding portion 50 by the liner forming tool 110, it is not strictly necessary to carry out the pressing step by the setting machine 200.

Next, a fifth embodiment of the method for manufacturing a cap according to the present invention will be described.

Figure 14:
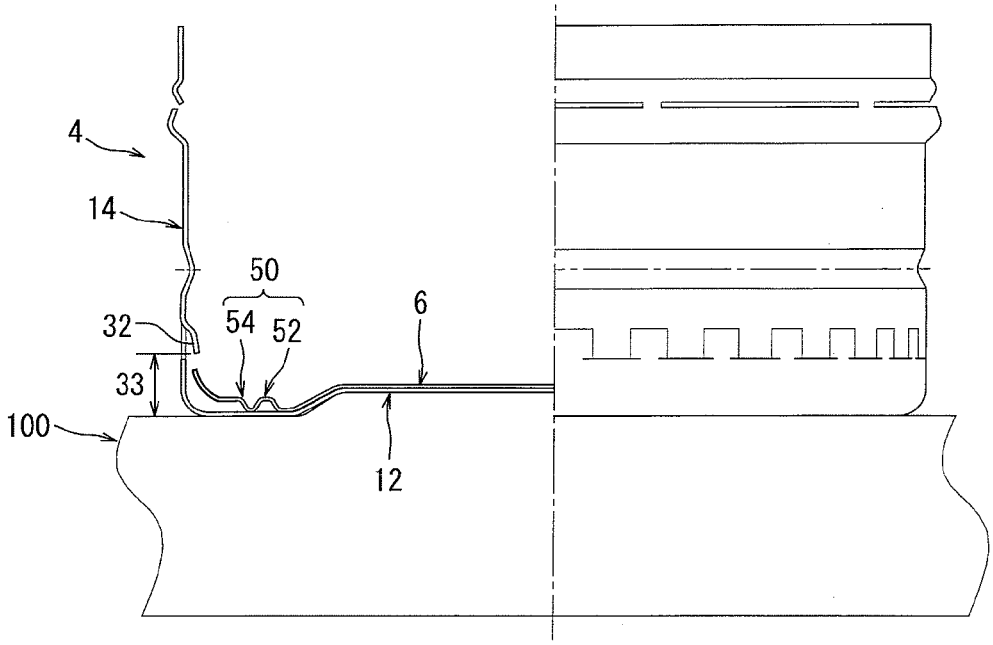
FIG. 14 is a side view showing, partly in section, a state where a sheet member in a fifth embodiment of the method for manufacturing a cap according to the present invention has been installed within the cap body.
Figure 15:
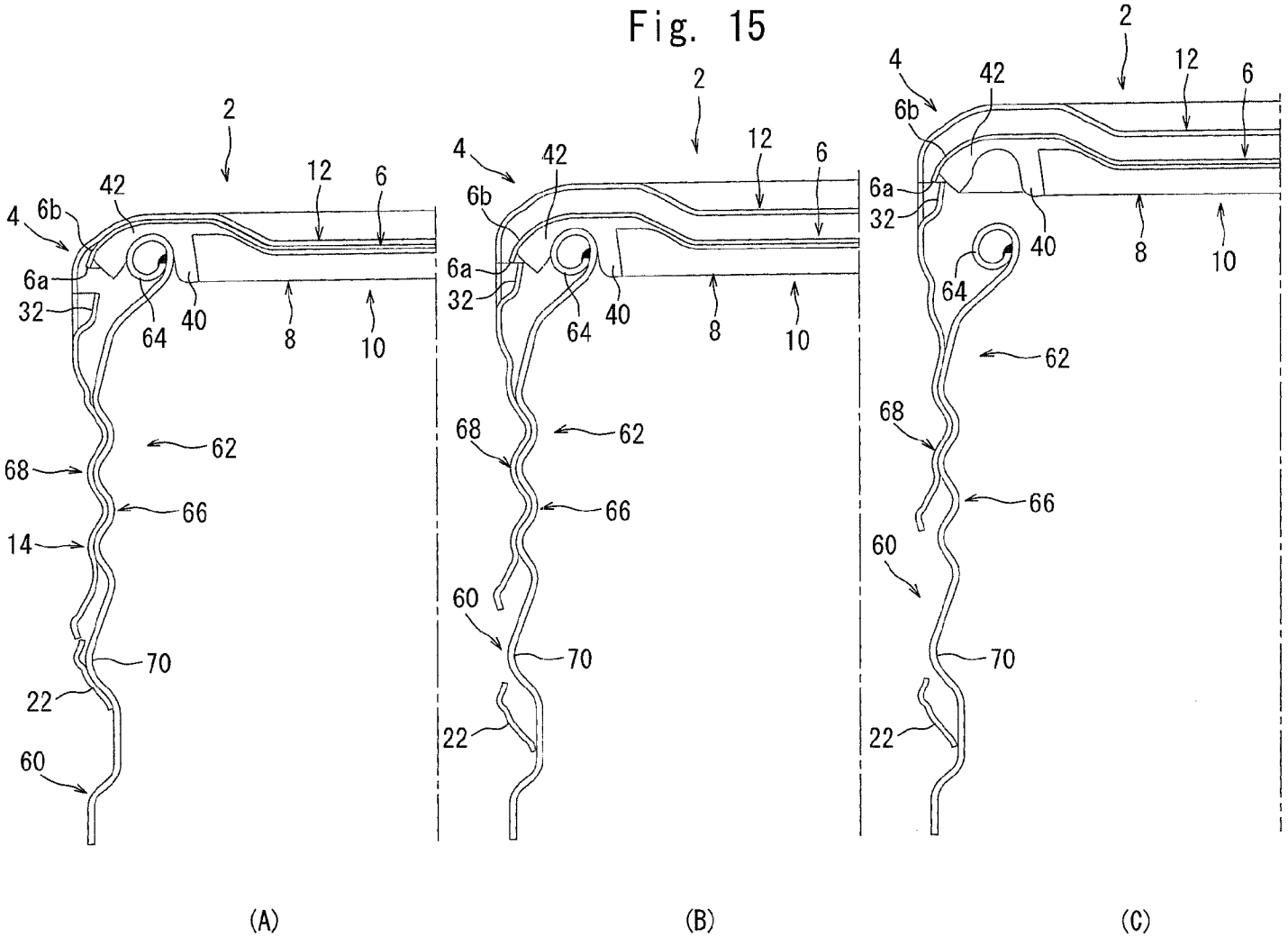
FIG. 15 are partial sectional views for illustrating a course from a state, where a mouth-and-neck portion of a container is sealed with the cap shown in any of the first to fifth embodiments of the method for manufacturing a cap according to the present invention, until the mouth-and-neck portion is unsealed.

FIG. 14 shows a state where a sheet member 6 provided with an annular protruding portion 50 in the present embodiment has been installed in a cap body 4. The annular protruding portion 50 is composed of the aforementioned annular protrusion 52 and annular stepped portion 54. As seen here, in the fifth embodiment as well, after the sheet member 6 is inserted into an inside plug holding region 33, the annular protrusion 52 and the annular stepped portion 54 are pressed axially toward the top panel wall 12, whereby the outer diameter of the sheet member 6 can be enlarged.

FIG. 15(A) to 15(C) show the course of unsealing a container sealed with a cap produced by the manufacturing method of the present invention common to the above first to fifth embodiments. FIG. 15(A) is a view showing a state where the metal cap 2 shown in FIG. 1 has been mounted on a mouth-and-neck portion 62 of a metal container 60. After contents such as a beverage are filled into the container, the metal cap 2 shown in FIG. 1 is put on the mouth-and-neck portion 62 of the metal container 60 for a sealing step. To ensure sealing, a shoulder in a boundary region between the top panel wall 12 and the skirt wall 14 of the cap body 4 is pressed by a tool (not shown) toward the outer peripheral surface of a curled portion 64 formed at the opening end of the mouth-and-neck portion 62 of the container 60. By this pressing action, the lower surface of the sealing surface 42 of the liner 8 is brought into intimate contact with the curled portion 64 and, at the same time, the peripheral edge curved portion is also pressed to decrease the outer diameter of the inside plug. According to the manufacturing method of the present invention, however, the outer diameter of the inside plug is enlarged sufficiently, and is not smaller than the inner diameter of the inside plug protruding portion 32. Separately, an internal thread portion 68, which engages an external thread portion 66 formed on the mouth-and-neck portion 62 of the container 60, is formed in the thread forming region of the skirt wall 14 by a different tool (not shown). Simultaneously, the lower surface of a bead 70 of the mouth-and-neck portion 62 is constricted so that the tamper evident band 22 engages the lower surface side of the bead 70. After filling of the contents, washing water (not shown) enters through the openings 30 to wash off the contents depositing on the mouth-and-neck portion of the container, thereby preventing an increase in a stopper opening torque due to sugar cement remaining on the mouth-and-neck portion. In this state, the metal container 60 is reliably sealed with the inner ring 40 and the sealing surface 42 of the liner 8. Moreover, the peripheral end edge 6*a* of the sheet member 6 of the inside plug 10 is spaced apart above the inside plug holding protruding portion 32 of the skirt wall 14.

Then, as shown in FIG. 15(B), the cap body 4 is turned in an unstopping direction in order to consume the contents. At this time, the bridge portions 26 connecting the cap body 4 and the tamper evident band 22 are broken, and the cap body 4, excluding the tamper evident band 22, is raised. The inside plug 10, as a separate body, is held in the inside plug holding region 33 so as to be axially movable, and is in close contact with the curled portion 64 via the liner 8. Thus, the inside plug, 10 does not rotate together with the cap body 4. This can decrease a rotating torque necessary for unstopping, facilitating unstopping with a slight force. Even at this point in time, the container 60 can be sealed with the inner ring 40 and the sealing surface 42.

As shown in FIG. 15(C), the cap body 4 continues to be turned in the unstopping direction and, upon further ascent of the cap body 4, the peripheral end edge 7*a* of the inside plug 10 is reliably locked to the inside plug holding protruding portion 32. Thus, the inside plug ascends together with the cap body 4 without departing from the inside plug holding region 33. As a result, the cap 2 is removed from the mouth-and-neck portion 62 of the container, with only the tamper evident band 22 remaining on the mouth-and-neck portion 62, so that the contents are consumed safely.

Next, a sixth embodiment of the method for manufacturing a cap according to the present invention will be described.

In the first to fifth embodiments of FIGS. 1 to 15(A) to 15(C), the cap body is formed from the metal sheet. However, the manufacturing method according to the present invention can be applied likewise to other embodiments, in which the cap body is integrally formed from synthetic resin, as in FIGS. 16 to 19.

Figure 19:
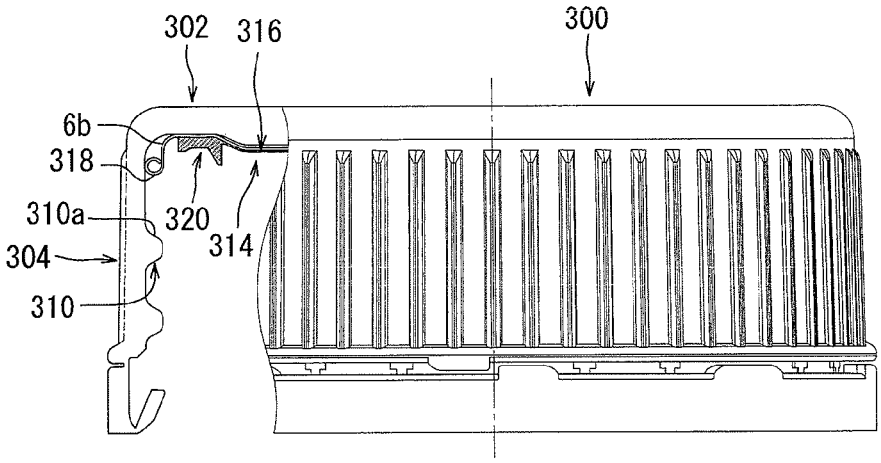
FIG. 19 is a side view showing, with essential parts in section, a cap manufactured by the sixth embodiment of the present invention.

An explanation will be offered only for parts of a cap according to the present invention having a synthetic resin cap body 300, the parts being different from those of the cap having the metal cap body. Referring to FIG. 19, an uppermost end part of an internal thread 310 of the synthetic resin cap body 300 defines an inside plug holding protruding portion 310*a*. In a central part of the inner surface of a top panel wall 302, there is formed a convexity 312 (indicated by an arrow from below in FIG. 19) protruding toward a lower part of the cap. The convexity 312 is of the same shape as that of the body convexity 34 formed in the cap body 4 shown in FIG. 1, and attains the same object. The convexity 312 with a hole provided in the center poses no problem, because the inside plug seals it, if the shape of the annular inclined surface defining the shape of the convexity coincides with the inclination of the upper surface of the peripheral edge part in the concavity of the sheet member, and enables the inside plug to be positioned in the center.

The sheet member 316 has substantially the same configuration as that of the sheet member 6 shown in FIG. 2, except that a curled portion 318 is formed at the lower end of the peripheral edge curved portion 6*b*. An inside plug concavity 36 of the sheet member 316 is fitted to the convexity 312 of the body, and is positioned coaxially. The outer diameter of the sheet member 316 defined by the outer peripheral surface of the curled portion 318 of the sheet member 316 is rendered slightly larger than the inner diameter of the internal thread 310 of the cap body 300. Thus, the curled portion 318, when inserted, is elastically displaced radially inwardly.

There is an embodiment in which the outer diameter of the sheet member is enlarged by a setting machine during insertion, as in the case of the metal cap body, although this is not shown. There is also an embodiment in which the outer diameter of the sheet member is not enlarged during insertion, but is enlarged by a forming tool at the time of liner forming, as will be explained later. A single sheet member may be forced open twice using both means.

Figure 16:
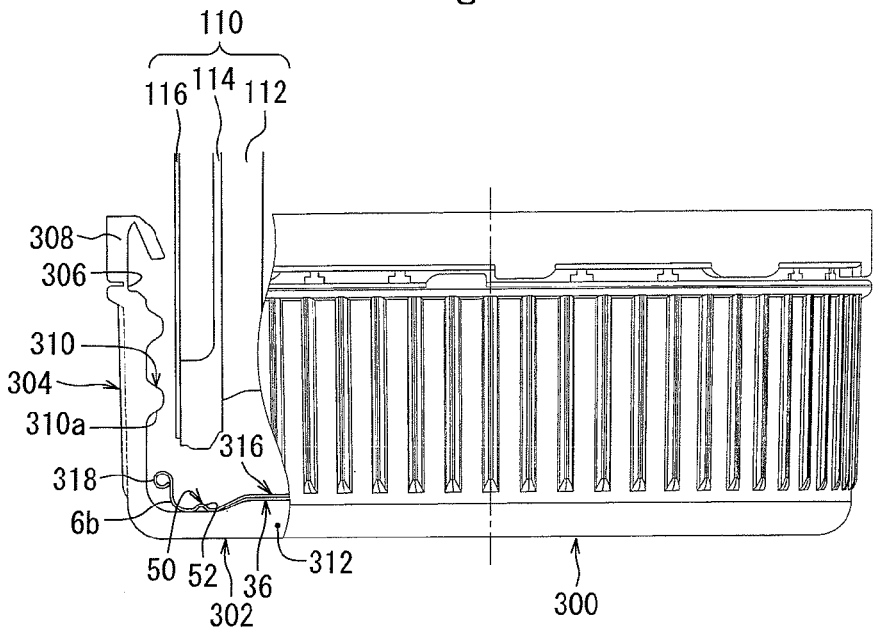
FIG. 16 is a side view showing, with essential parts in section, a state where a sheet member, molten resin, and a forming tool have been inserted into a synthetic resin cap body in a sixth embodiment of the method for manufacturing a cap according to the present invention.
Figure 17:
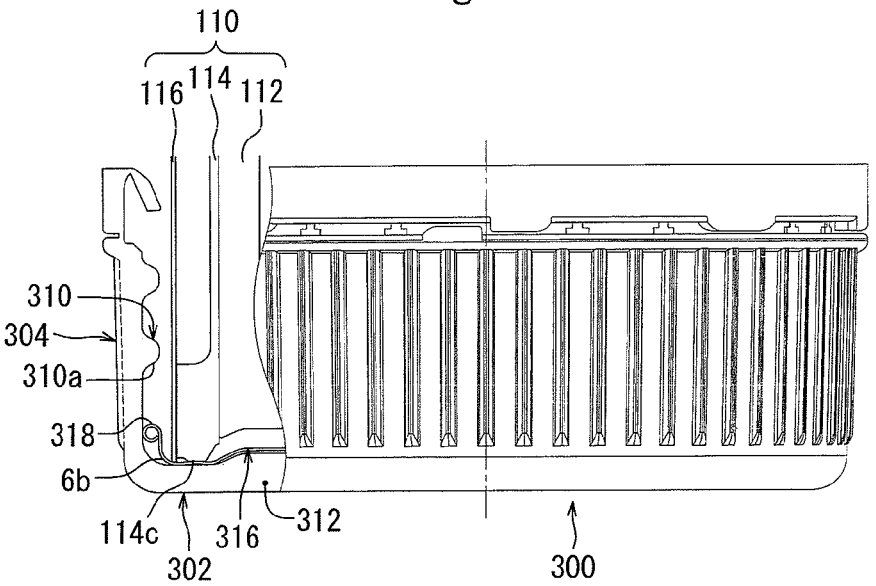
FIG. 17 is a side view showing, with essential parts in section, a state where the forming tool has been further lowered from the state of FIG. 16 to press the annular protruding portion of the sheet member.

After the setting machine 200 (see FIG. 9) is removed from the cap body 300, the forming tool 110 is inserted into the cap body 300, and the annular flat lower surface 114*c* of the intermediate pressing sleeve 114 presses the annular protrusion 52 of the sheet member 6 axially against the top panel wall 302 to deform it, as shown in FIGS. 16 to 17. Thus, the outer diameter of the sheet member 316 is enlarged.

There is another embodiment in which the peripheral edge curved portion 7*b* of the sheet member 316 is pressed in the axial direction by the forming tool 110 or the setting machine 200 from the cap opening side toward the top panel wall 302, thereby further enlarging the outer diameter of the sheet member 316. There is still another embodiment in which the forming tool 110 or the setting machine body 202 is pressed outwardly from the radically inward side of the curled portion 318 to further enlarge the outer diameter of the sheet member 316. These embodiments are carried out after or at the same time that the annular protruding portion 50 is pressed for deformation, like the previous embodiments.

Figure 18:
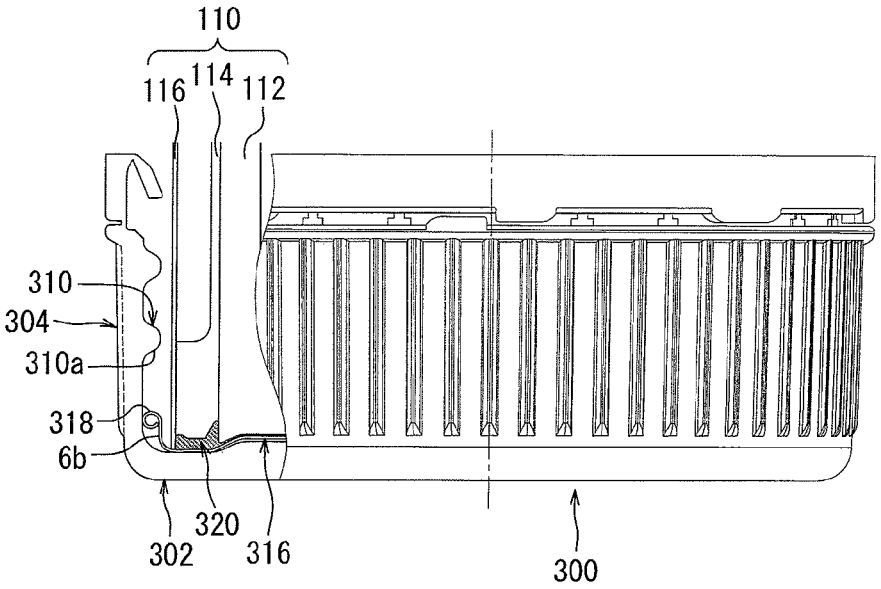
FIG. 18 is a side view showing, with essential parts in section, a state where a synthetic resin liner has been press-formed, starting from the state of FIG. 17.

After the outer diameter of the sheet member is enlarged by the forming tool 110, the molten resin (not shown) is compressed, and a liner 320 is integrally formed on the lower surface of the sheet member 316 (see FIG. 18).

In connection with the inside plug holding protruding portion, there is another embodiment in which an inside plug holding protruding portion (not shown) is formed, separately from the internal thread 310 or 68, above the internal thread 310 or 68 on the inner surface of the skirt wall 304 or 14. There is an additional embodiment in which the upper end surface of the internal thread 68 is utilized, as an inside plug holding protruding portion, in the cap body 4 of the previous embodiments.

Next, a seventh embodiment of the present invention will be described.

With the present invention, it is an important feature that in producing a metal cap having the above-mentioned basic configuration, the sheet member 6 is inserted into a predetermined position within the cap body 4, whereby the peripheral edge curved portion 6*b* of the sheet member 6 is forced open in order to enlarge the outer diameter of the sheet member 6.

FIGS. 20(A), 20(B) are views for illustrating the manufacturing method of the present invention. These views show a state where the sheet member 6 has been inserted into the cap body 4 having the aforementioned configuration, the cap body being installed, with a top panel wall 12 being placed on a forming stand 90, and the opening end edge of a skirt wall 14 facing upward. As will be clear from FIG. 20(A), the outer diameter of the sheet member 6 inserted into the cap body 4 is equal to or slightly larger than the inner diameter of a free end edge 32*a* supporting the sheet member 6. Thus, the sheet member 6 is inserted into the predetermined position inside the cap body 4 without being plastically deformed.

Then, molten resin (not shown) supplied onto the sheet member 6 is press-formed by a forming tool 90 to form a liner integrally on the sheet member 6. The forming tool 90 is composed of a central punch 92, an intermediate pressing sleeve 93, and a positioning sleeve 94. First of all, the outer peripheral edge of the liner is defined by the positioning sleeve 94 so that the molten resin will not extend off outside. Then, the molten resin is formed by the central punch 92 and the intermediate pressing sleeve 93 into a liner having an inner ring 40, a sealing surface 42 and a thin-walled central portion 38 as stated earlier.

As will be clear from FIG. 20(B), at the same time that the forming tool 91 lowers to perform forming of the liner, the positioning sleeve 94 presses the peripheral edge curved portion 6*b* of the sheet member 6 from above, thereby forcing the curved portion open. That is, the peripheral edge curved portion 6*b* enters a state before forcing-open, which is indicated by a dashed double-dotted line in FIG. 20(B), and a state after forcing-open, which is indicated by a solid line in FIG. 20(B). Consequently, the sheet member 6 (inside plug 5) having the liner formed therein is reliably held between the top panel wall 12 and the free end edge 32*a* of the cap body 4.

Figure 21:
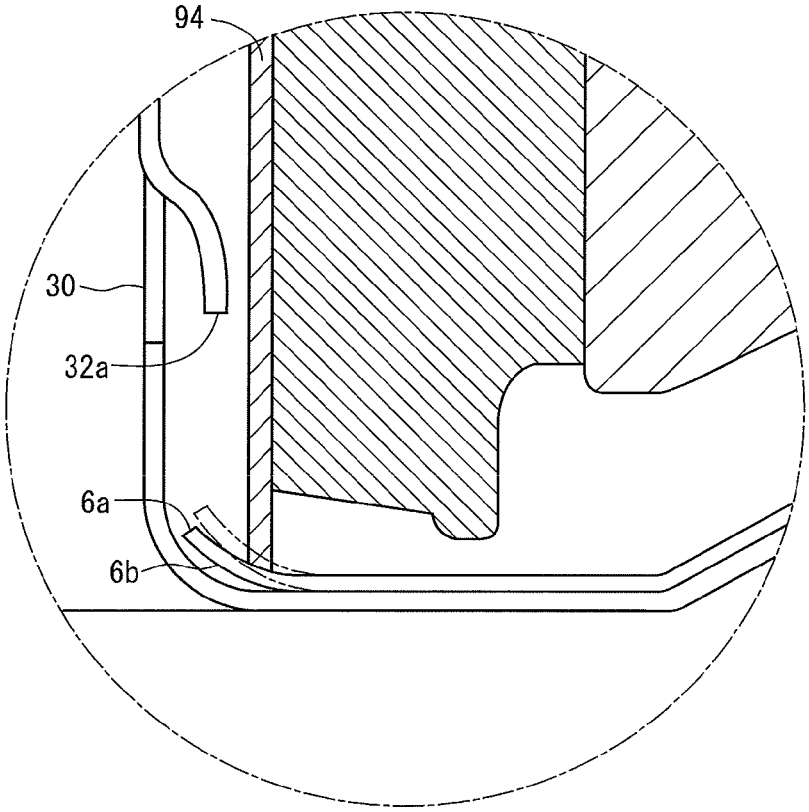
FIG. 21 is a view showing, on an enlarged scale, essential parts of the metal cap shown in FIG. 20B.

In the manufacturing method of the present invention, moreover, the shape of the front end surface of the pressing sleeve pressing the outer peripheral edge part of the sheet member is rendered the same as the shape of a part of the forced-open sheet member in contact with the front end surface, as clear from FIG. 21. Thus, the shape of the sheet member after being forced open can be retained stably.

Next, an eighth embodiment of the present invention will be described.

In the example shown in FIGS. 20(A), 20(B) and FIG. 21, the resulting cap has the metal cap body combined with the inside plug. However, a cap can be produced similarly even when a resin cap body is combined with an inside plug.

Figure 22:
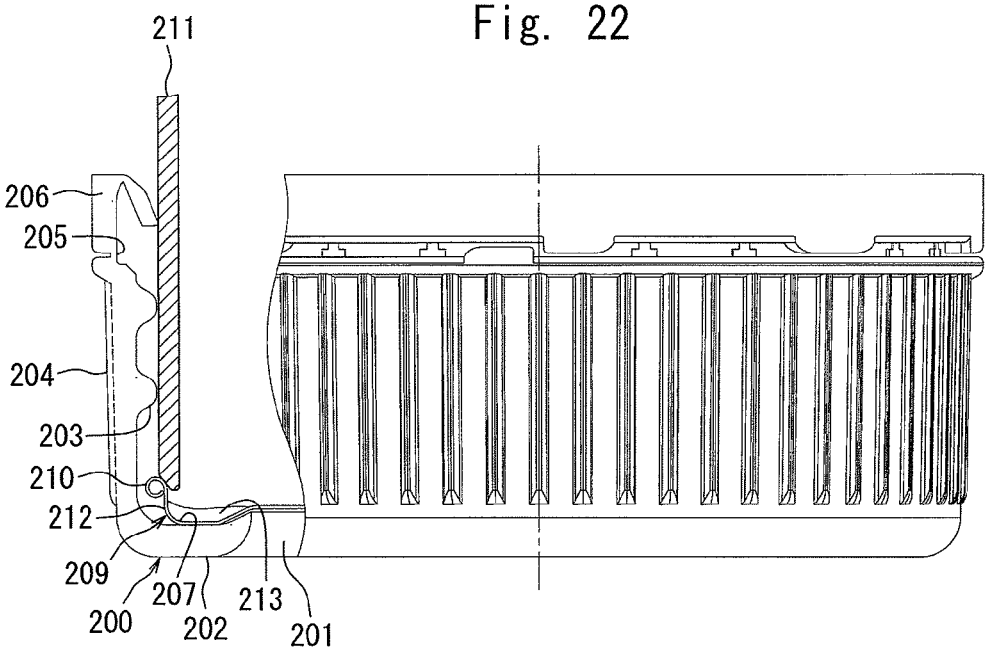
FIG. 22 is a view showing an example of an inside plug-equipped resin cap formed by a method for manufacturing a cap to be produced according to an eighth embodiment of the present invention.

As shown in FIG. 22, a resin cap body 200 comprises a top panel wall 202 having an opening 201 formed in the center thereof, and a skirt wall 204 having a threaded portion 203 in the inner surface thereof. The skirt wall 204 has a main section 20 disposed above, and a tamper evident band 206 integrally formed at the lower end of the main section via weakened portions 205. The lower surface of a side end part of the opening 201 of the top panel wall 202 is inclined downwardly in a radially inward direction, and assumes a shape coinciding with the concavity of a sheet member 207, thus enabling an inside plug 209 to be positioned in the cap body, as in the case of a cap equipped with an inside plug in the metal cap body. The cap having the inside plug in the resin cap body is constituted by inserting into the resin cap body 200 the inside plug 209 having an annular liner 213 integrally formed on the sheet member 207.

A curled portion 210 is formed in an outer peripheral end part 212 of the sheet member 207. As shown in FIG. 22, a side of the curled portion 210 inward of the center of a cross-sectional curl of the curled portion is forced open by an annular sleeve 211, whereby the inside plug can be efficiently installed, as in FIG. 20 and FIG. 21.

In this embodiment, when the resin cap mounted on a container is turned in an unstopping direction (stopper-opening direction), the cap begins to ascend along the thread, whereas a locking means present on the inner side of the tamper evident band 206 engages a locked means (not shown) of a container mouth to fix the tamper evident band 206 there. Thus, the weakened portions 205 connecting the main section of the skirt wall and the tamper evident band 206 are broken. When the cap body 8 continues to ascend further, the curled portion of the inside plug 5 is locked to the uppermost end surface of the threaded portion 203. Thus, the cap is removed from the container mouth such that the inside plug 5 ascends together with the cap body 200 without departing from the cap body 200.

In this embodiment, the opening 201 is formed in the top panel wall 202 of the cap body 200, and the inside plug 5 covers the opening 201. It goes without saying that the top panel wall may have no opening 201. Needless to say, a support portion comprising an annular projection or the like, which is locked to the inside plug to hold the inside plug within the cap body, may be separately formed above the threaded portion.

Figure 20:
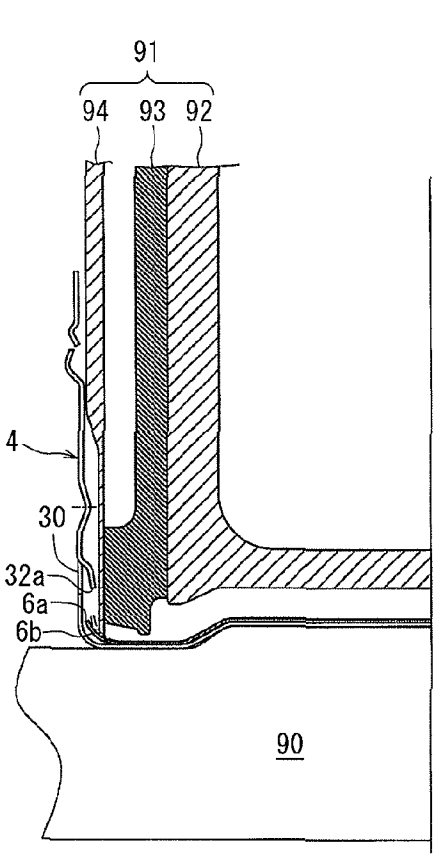
FIG. 20 are views for illustrating a method for manufacturing a cap to be produced according to a seventh embodiment of the present invention.
Figure 20:
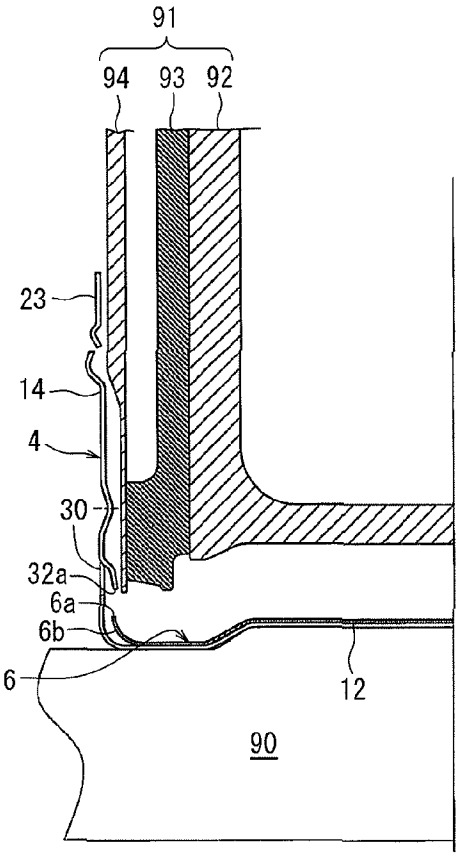

In the metal cap body shown in FIG. 20, the opening 30 for introducing washing water is utilized, and the region 27 below the opening 30 is protruded radially inwardly, whereby the inside plug 5 is locked to the cap body 4. In the metal cap body as well, like the above-mentioned resin cap body, the upper end surface of the thread may be utilized, or a support portion for holding the inside plug within the cap body may be separately formed, for example, by forming above the threaded portion an annular projection protruding radially inwardly.

The outer end edge of the sheet member 6 need not be curled particularly when the sheet member comprises an aluminum plate. If the sheet member comprises a steel sheet such as a tin-free steel or tinplate, however, the outer end edge of the sheet member should desirably be curled for end edge protection from the viewpoint of rust prevention.

The concavity formed in the center of the sheet member is effective in positioning the sheet member in the metal cap body, as shown in FIGS. 1 to 14 and FIG. 20. If its positioning is possible using any other means, however, it is not absolutely necessary to form the concavity.

Furthermore, the liner is not limited to one formed by press-forming molten resin on the sheet member, but can be formed by a publicly known method such as spin lining.

The method for manufacturing a cap having an inside plug according to the present invention can insert the sheet member easily into the cap body without causing deformation of the inside plug in installing the inside plug in the cap body. This method also makes it possible to use an inside plug having an outer diameter which eliminates separation from the cap body. Thus, the method can be used preferably for the manufacture of an inside plug-equipped cap for use on a container whose interior is placed under reduced pressure by hot filling or the like.

Besides, the outer diameter of the sheet member can be enlarged simultaneously with the formation of the liner material. Thus, the number of the steps is small, and productivity and economy are excellent. Hence, the manufacturing method can be used preferably for a general-purpose cap requiring mass production.

In addition, the cap produced by the method of the present invention has the sheet member on the top panel wall, thus requiring a low torque for stopper opening and ensuring excellent gas barrier properties. Accordingly, the method can be used preferably for the manufacture of a cap used for a container to be filled with contents or the like which are greatly affected by oxygen.

EXPLANATIONS OF LETTERS OR NUMERALS

2: Metal cap
4: Cap body
6: Metallic sheet member
7: Outer peripheral part
7*a*: Peripheral end portion
7*b*: Peripheral edge curved portion
7*c*: Annular flat region
8: Liner
10: Inside plug
12: Top panel wall
14: Skirt wall
32: Inside plug holding protruding portion
33: Inside plug holding region
50: Annular protruding portion
52: Annular protrusion
54: Annular stepped portion
60: Metal container
110: Forming tool
200: Setting machine
300: Synthetic resin cap

The invention claimed is:

1. A method for manufacturing a cap comprising a cap body, an inside plug, and a synthetic resin liner, said cap body having a circular top panel wall and a cylindrical skirt wall extending downwardly from a peripheral edge of the top panel wall, said inside plug including a circular metallic sheet member having an annular flat region in an outer peripheral part thereof, and said synthetic resin liner being disposed by press-forming on a lower surface of the sheet member, wherein an inside plug holding protruding portion protrudes radially inwardly from an upper end part of the skirt wall of the cap body, said method comprising:

inserting and installing, via a setting machine, the sheet member inside the skirt wall of the cap body so as to be positioned inside a plug holding region located above the inside holding protruding portion, said sheet member having an annular protruding portion formed on the annular flat region and protruding on a lower surface side or an upper surface side of the annular flat region of the sheet member; and at the same time, or after the inserting and installing, pressing, with the setting machine, the annular protruding potion in an axial direction of the cap body toward the top panel wall and deforming the annular protruding portion, wherein the deforming causes:

the annular protruding portion to assume close to a flattened shape; and an outer diameter of the sheet member to be made larger than an inner diameter of the inside plug holding protruding portion to a point wherein the inside plug is retained inside the plug holding region so as to be axially retained between the inside plug holding protruding portion and an inner surface of the top panel wall, wherein, when the cap is in an installed state defined as the cap being mounted on a container, the inside plug is prevented from being brought into intimate contact with the cap body and from rotating together with the cap body at the time of unstopping.

2. The method of claim 1, wherein the annular protruding portion of the sheet member is a cross-sectionally arched shaped protruding portion.

3. The method of claim 1, wherein the annular protruding portion of the sheet member is a step-shaped protruding portion.

4. The method of claim 1, wherein the outer peripheral part of the sheet member has a peripheral edge part region including a circular peripheral end edge and the annular flat region continuing radially inwardly from the peripheral edge part region, the peripheral edge part region being composed of a peripheral edge curved portion curved on the lower surface side from the peripheral edge of the annular flat region such that the peripheral end edge faces the lower surface side, and the peripheral end edge of the peripheral edge curved portion defines the peripheral end edge of the sheet member.

5. The method of claim 4, wherein at the same time or after the annular protruding portion is pressed in the axial direction, the peripheral edge curved portion is pressed from the lower surface side in the axial direction toward the top panel wall and forced open radially outwardly, whereby the outer diameter of the sheet member is further enlarged.

6. The method of claim 1, wherein the cap body is made of a metal sheet, a plurality of openings are formed at circumferentially spaced intervals in an upper end part of the skirt wall of the cap body, and each of the openings is formed by protruding radially inwardly a lower region along a cutting line engraved in a circumferential direction in the skirt wall, whereby the inside plug holding protruding portion is defined by the lower region.

7. The method of claim 6, wherein a front end surface of a pressing sleeve that presses the outer peripheral edge part of the sheet member has a flattened shape.

8. The method of claim 1, wherein the cap body is composed of a metal, a plurality of openings are formed at circumferentially spaced intervals in an upper end part of the skirt wall, and a support portion is formed along the openings by protruding radially inwardly a lower region along a cutting line engraved in the skirt wall.

9. A method for manufacturing a cap comprising a cap body, an inside plug, and a synthetic resin liner, said cap body having a circular top panel wall and a cylindrical skirt wall extending downwardly from a peripheral edge of the top panel wall, said inside plug including a circular metallic sheet member having an annular flat region in an outer peripheral part thereof, and said synthetic resin liner being disposed by press-forming on a lower surface of the sheet member, wherein an inside plug holding protruding portion protrudes radially inwardly from an upper end part of the skirt wall of the cap body, said method comprising:

inserting and installing, via a setting machine, the sheet member inside the skirt wall of the cap body so as to be positioned inside a plug holding region located above the inside holding protruding portion, said sheet member having an annular protruding portion formed on the annular flat region and protruding on a lower surface side or an upper surface side of the annular flat region of the sheet member; and at the same time, or after the inserting and installing, pressing the annular protruding portion in an axial direction of the cap body toward the top panel wall and deforming the annular protruding portion; and compressing, with a forming tool, molten resin on the lower surface side of the sheet member so as to form a liner on the lower surface side of the sheet member, wherein the deforming causes:

the annular protruding portion to assume close to a flattened shape; and an outer diameter of the sheet member to be made larger than an inner diameter of the inside plug holding protruding portion to a point wherein the inside plug is retained inside the plug holding region so as to be movable between the inside plug holding protruding portion and an inner surface of the top panel wall, wherein, when the cap is in an installed state defined as the cap being mounted on a container, the inside plug is prevented from being brought into an intimate contact with the cap body and from rotating together with the cap body at the time of unstopping.

10. A method for manufacturing an inside plug-equipped cap comprising a cap body formed with a circular top panel wall and a skirt wall, an inside plug having a circular metallic sheet member, and a resin liner press-formed on an inner surface side of the sheet member, said method comprising:

inserting and installing the sheet member in an inside plug holding region of the cap body;

after or at a same time as the inserting and installing, forcing open an outer peripheral edge part of the sheet member to be larger than an inner diameter of the support portion, whereby the inside plug is held by a support portion formed on an inner side of an upper part of the skirt wall in such a manner as to be inseparable from the cap body and movable upward and downward at a predetermined position above the support portion, wherein, when the cap is in an installed state defined as the cap being mounted on a container, the inside plug is prevented from being brought into an intimate contact with the cap body and from rotating together with the cap body at the time of unstopping;

during the forcing open, forming the resin liner by compressing molten resin on the inner surface of the sheet member.

11. A method for manufacturing an inside plug-equipped cap comprising a cap body formed with a circular top panel wall and a skirt wall, an inside plug having a circular metallic sheet member, and a resin liner press-formed on an inner surface side of the sheet member, said method comprising:

inserting and installing the sheet member in an inside plug holding region of the cap body;

after or at the same time as the inserting and installing, utilizing an annular sleeve to force open an outer peripheral edge part of the sheet member to be larger than an inner diameter of the support portion, whereby the inside plug is held by a support portion formed on an inner side of an upper part of the skirt wall in such a manner as to be inseparable from the cap body and movable upward and downward at a predetermined position above the support portion, wherein, when the cap is in an installed state defined as the cap being mounted on a container, the inside plug is prevented from being brought into an intimate contact with the cap body and from rotating together with the cap body at the time of unstopping.

* * * * *